US008973309B2

(12) United States Patent
Amir

(10) Patent No.: US 8,973,309 B2
(45) Date of Patent: Mar. 10, 2015

(54) TOWER STRUCTURE

(75) Inventor: Yossi Amir, Yokneam (IL)

(73) Assignees: S. Cohen & Co.-Trust Company Ltd., Nesher (IL); Yossi Amir, Yokneam (IL)

( * ) Notice: Subject to any disclaimer, the term of this patent is extended or adjusted under 35 U.S.C. 154(b) by 0 days.

(21) Appl. No.: 14/003,169

(22) PCT Filed: Mar. 22, 2012

(86) PCT No.: PCT/IL2012/000128

§ 371 (c)(1),
(2), (4) Date: Oct. 24, 2013

(87) PCT Pub. No.: WO2012/127467

PCT Pub. Date: Sep. 27, 2012

(65) Prior Publication Data

US 2014/0041314 A1 Feb. 13, 2014

Related U.S. Application Data

(60) Provisional application No. 61/465,628, filed on Mar. 23, 2011.

(51) Int. Cl.
*E04B 7/10* (2006.01)
*E04H 12/16* (2006.01)
(Continued)

(52) U.S. Cl.
CPC ..... *E04H 12/16* (2013.01); *E04H 12/10* (2013.01); *E04H 12/20* (2013.01); *Y10S 52/10* (2013.01)
USPC ..... 52/80.2; 52/40; 52/65; 52/DIG. 10; 52/81.1; 52/80.1; 52/651.07; 52/745.04; 52/651.09

(58) Field of Classification Search
USPC ..... 52/8, 223.13, 223.14, 223.4, 80.2, 65, 52/247, 40, 300, 651.07, 855, 853, 82, 52/651.08, 651.09, 80.1, DIG. 10, 81.1, 52/745.04; 174/45 R
See application file for complete search history.

(56) References Cited

U.S. PATENT DOCUMENTS 2,804,950 A * 9/1957 Leslie, Jr. ..... 52/117
3,125,189 A * 3/1964 Graham ..... 52/65
(Continued)

FOREIGN PATENT DOCUMENTS

DE 10316405 A1 10/2004
JP 04-189986 A 7/1992
(Continued)

OTHER PUBLICATIONS

An International Search Report and a Written Opinion both dated Aug. 17, 2012, which issued during the prosecution of Applicant's PCT/IL12/000128.
(Continued)

*Primary Examiner* — Chi Q Nguyen
(74) *Attorney, Agent, or Firm* — Sughrue Mion, PLLC

(57) ABSTRACT

A tower structure including a central, vertical mast and a plurality of tensioned elongate elements arranged to support the mast against buckling, the plurality of tensioned elements together defining a generally hyperboloid structure and including a first plurality of elongate elements which define a multiplicity of junctions therebetween, a second plurality of junction-to-mast joining elongate elements which join at least some of the multiplicity of junctions to the central, vertical mast; and a third plurality of junction-to-junction joining elongate elements which are connected at a plurality of mutually spaced fixed locations therealong to the at least some of the multiplicity of junctions.

10 Claims, 47 Drawing Sheets

(51) Int. Cl.
*E04H 12/10* (2006.01)
*E04H 12/20* (2006.01)

(56) References Cited

U.S. PATENT DOCUMENTS

| | | | | | |
|---|---|---|---|---|---|
| 3,246,431 | A | * | 4/1966 | Faerber | 52/65 |
| 3,388,512 | A | * | 6/1968 | Newman | 52/64 |
| 3,856,639 | A | * | 12/1974 | Rohn et al. | 362/35 |
| 3,895,495 | A | * | 7/1975 | Akazaki et al. | 405/200 |
| 3,905,166 | A | | 9/1975 | Kaiser | |
| 3,922,827 | A | | 12/1975 | Rosenblatt | |
| 4,148,850 | A | | 4/1979 | Schulte et al. | |
| 4,167,740 | A | * | 9/1979 | Shriver | 343/882 |
| 4,326,363 | A | | 4/1982 | Leonhardt et al. | |
| 4,388,785 | A | * | 6/1983 | Queffelec et al. | 52/222 |
| 4,473,976 | A | | 10/1984 | Kuznetsov et al. | |
| 4,520,600 | A | * | 6/1985 | Bordet | 52/83 |
| 5,072,553 | A | | 12/1991 | Bozetto et al. | |
| 5,832,688 | A | * | 11/1998 | Crissey et al. | 52/651.01 |
| 6,935,076 | B2 | * | 8/2005 | Amir | 52/80.2 |
| 8,434,274 | B2 | * | 5/2013 | Anderson, Jr. | 52/101 |
| 8,696,479 | B2 | * | 4/2014 | Marks et al. | 472/131 |

FOREIGN PATENT DOCUMENTS

| | | | |
|---|---|---|---|
| JP | 06-346634 | A | 12/1994 |
| JP | 2003-027768 | A | 1/2003 |
| SU | 1006685 | A | 3/1983 |
| WO | 2012/127467 | A1 | 9/2012 |

OTHER PUBLICATIONS

An International Preliminary Report on Patentability dated Sep. 24, 2013, which issued during the prosecution of Applicant's PCT/IL12/000128.

E. Heinle and F. Leonhardt, Towers: A Historical Survey, Butterworth Architecture, English translation, 1989, pp. 98-99 (The Sydney Center Point Tower).

Hyperboloid Structure, downloaded from <http://en.wikipedia.org/wiki/Hyperboloid_structure> on Jan. 27, 2012.

U.S. Appl. No. 61/465,628, filed Mar. 23, 2011.

* cited by examiner

Fig. 6II
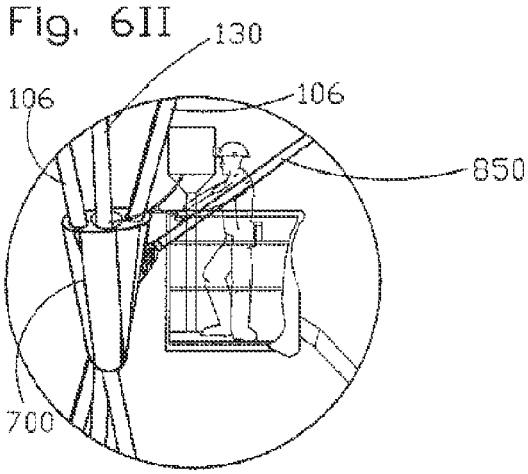
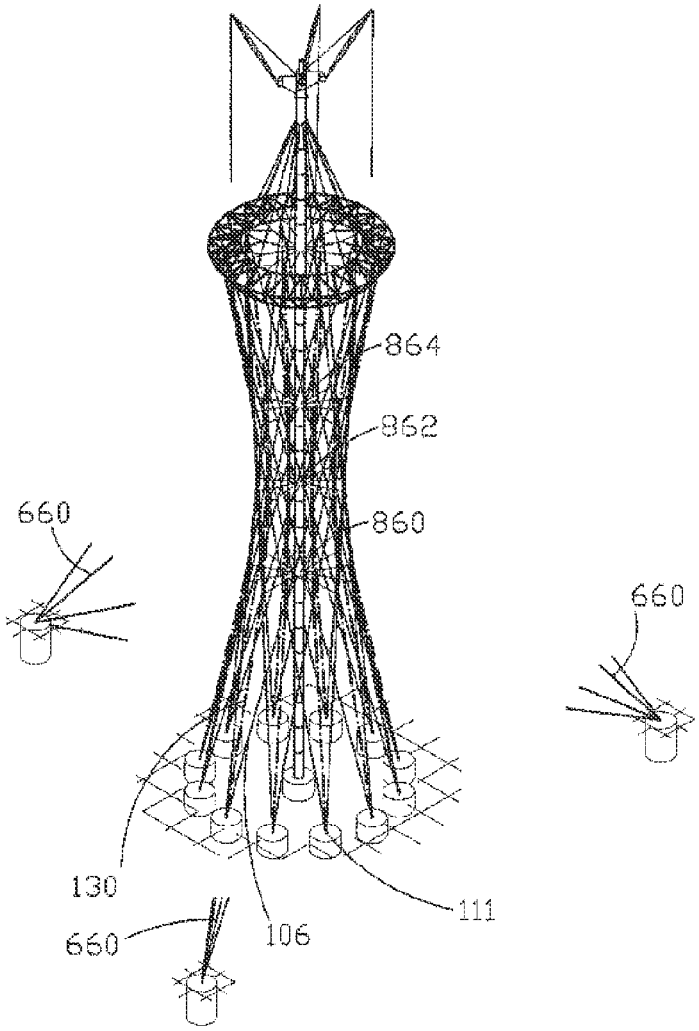

TOWER STRUCTURE

REFERENCE TO RELATED APPLICATIONS

Reference is hereby made to U.S. Provisional Patent Application Ser. No. 61/465,628, filed Mar. 23, 2011 and entitled "Slender Mast-Levitating Ring-Tower Structure," the disclosure of which is hereby incorporated by reference in its entirety and priority of which is hereby claimed pursuant to 37 CFR 1.78(a) (4) and (5)(i).

FIELD OF THE INVENTION

The present invention relates to building structures generally and more particularly to tower structures employing tensioned structural elements.

BACKGROUND OF THE INVENTION

The following publications are believed to represent the current state of the art:

U.S. Pat. Nos. 3,922,827 and 4,473,976;

Japanese Patent Publication Nos. 04189986, 06346634 and 2003027768;

German Patent Publication No. 10316405;

E. Heinle and F. Leonhardt, Towers: A Historical Survey, Butterworth Architecture, English translation, 1989, pp 98-99; and Hyperboloid Structure, downloaded from http://en.wikipedia.org/wiki/Hyperboloid_structure on Jan. 27, 2012.

SUMMARY OF THE INVENTION

The present invention seeks to provide an improved tower structure employing tensioned structural elements.

There is thus provided in accordance with a preferred embodiment of the present invention a tower structure including a central, vertical mast and a plurality of tensioned elongate elements arranged to support the mast against buckling, the plurality of tensioned elements together defining a generally hyperboloid structure and including a first plurality of elongate elements which define a multiplicity of junctions therebetween, a second plurality of junction-to-mast joining elongate elements which join at least some of the multiplicity of junctions to the central, vertical mast; and a third plurality of junction-to-junction joining elongate elements which are connected at a plurality of mutually spaced fixed locations therealong to the at least some of the multiplicity of junctions.

Preferably, the first plurality of tensioned elongate elements are at least generally straight. Additionally or alternatively, the third plurality of tensioned elongate elements are generally parabolic.

In accordance with a preferred embodiment of the present invention the tower structure also includes a multiplicity of connectors operative to interconnect the first plurality of tensioned elongate elements with the second plurality of elongate elements and the third plurality of tensioned elongate elements at the multiplicity plurality of junctions.

In accordance with a preferred embodiment of the present invention the tower structure also includes a ring truss structure. Additionally the ring truss structure preferably houses a restaurant facility, the restaurant facility having a ring configuration and extending generally in a circle through 360 degrees in a plane perpendicular to the mast, the ring configuration providing both interior facing and exterior facing views.

Preferably, the restaurant facility includes multiple seating levels.

In accordance with a preferred embodiment of the present invention the interior facing views include views of substantially the entire restaurant facility and the ring truss structure as well as of tensioned elements of the tower structure.

In accordance with a preferred embodiment of the present invention the tower structure also includes multiple 360 degree ring platforms at least one of which is stationary and at least part of at least another of which is driven in 360 degree motion in a horizontal plane about the mast.

There is also provided in accordance with a preferred embodiment of the present invention a restaurant facility mounted on a ring truss structure forming part of a tower structure having a mast, the restaurant facility having a ring configuration and extending generally in a circle through 360 degrees in a plane perpendicular to the mast, the ring configuration providing both interior facing and exterior facing views.

Preferably, the restaurant facility includes multiple seating levels.

In accordance with a preferred embodiment of the present invention the the interior facing views include views of substantially the entire restaurant facility and the ring truss structure as well as of tensioned elements of the tower structure.

Preferably, the restaurant facility includes multiple 360 degree ring platforms at least one of which is stationary and at least part of at least another of which is driven in 360 degree motion in a horizontal plane about the mast.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1A:
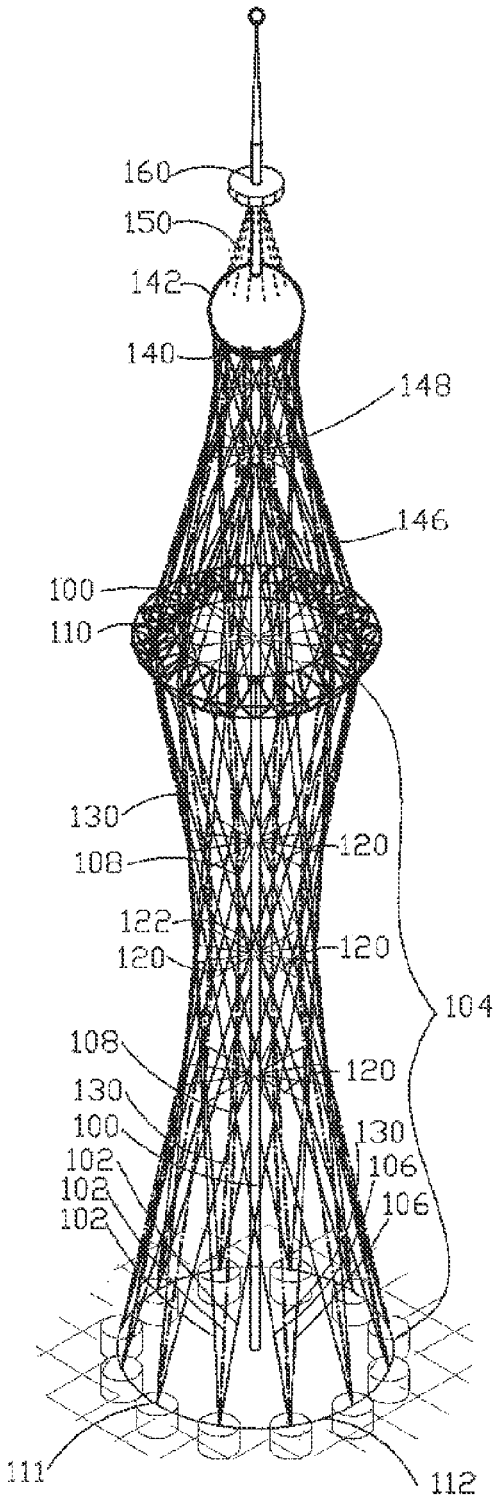
FIGS. 1A and 1B are simplified respective pictorial and side view illustrations of a tower structure constructed and operative in accordance with a preferred embodiment of the present invention.
Figure 1B:
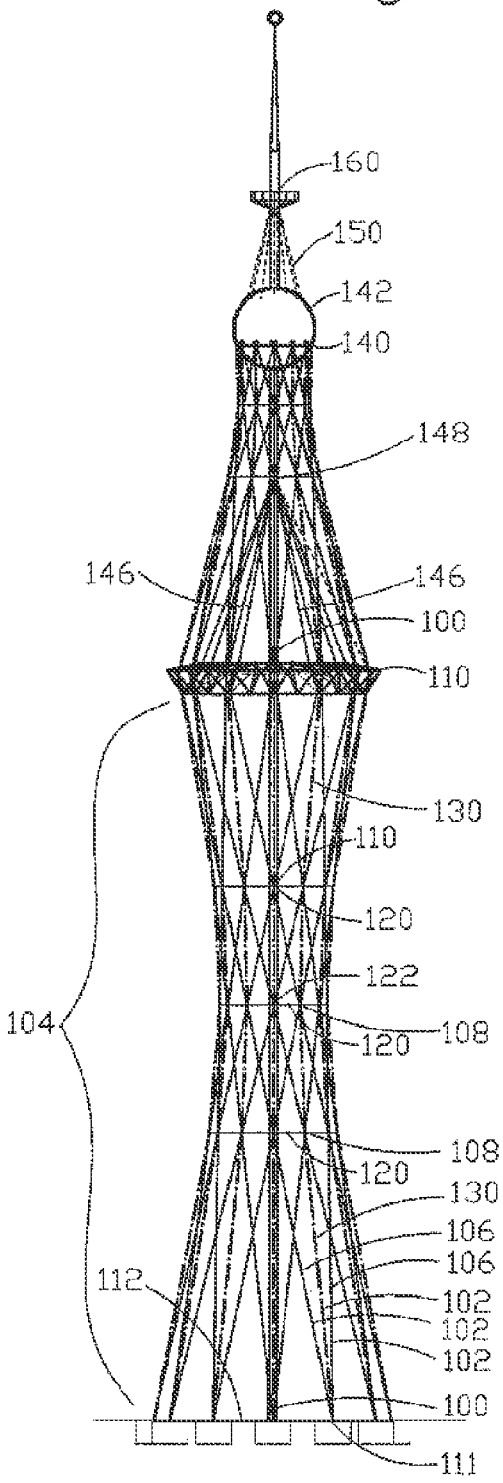
Figure 2:
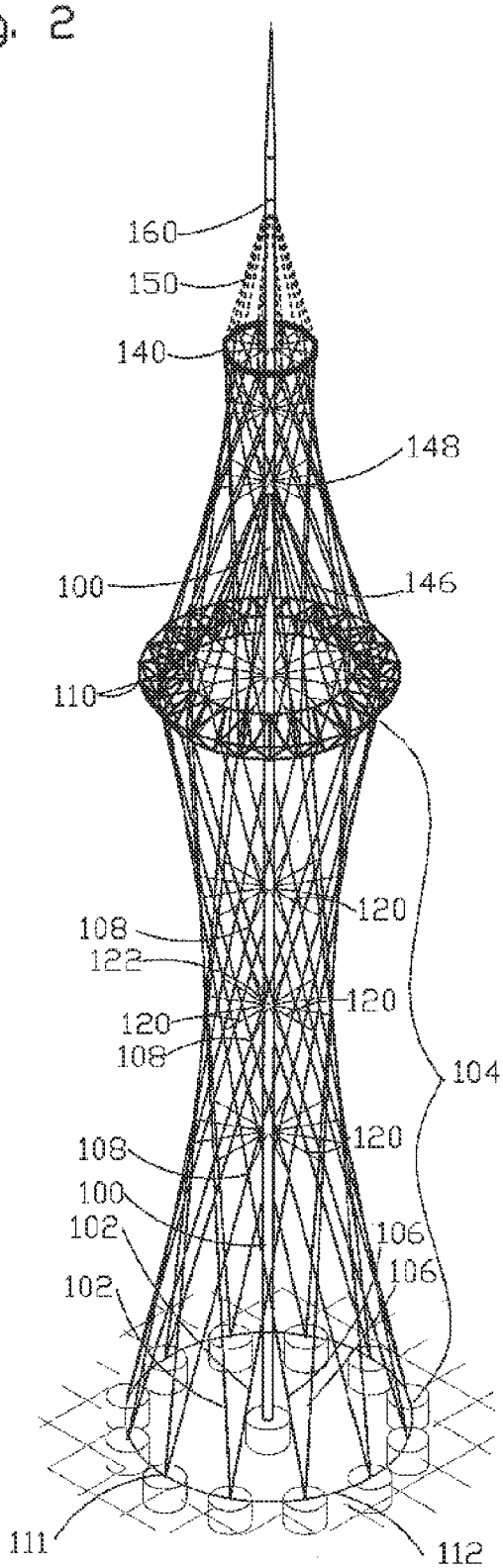
FIG. 2 is a simplified pictorial view of the mast and hyperbolic structure elements and the junction-to-mast joining elements in an incomplete rendering of the tower structure of FIGS. 1A and 1B.
Figure 3:
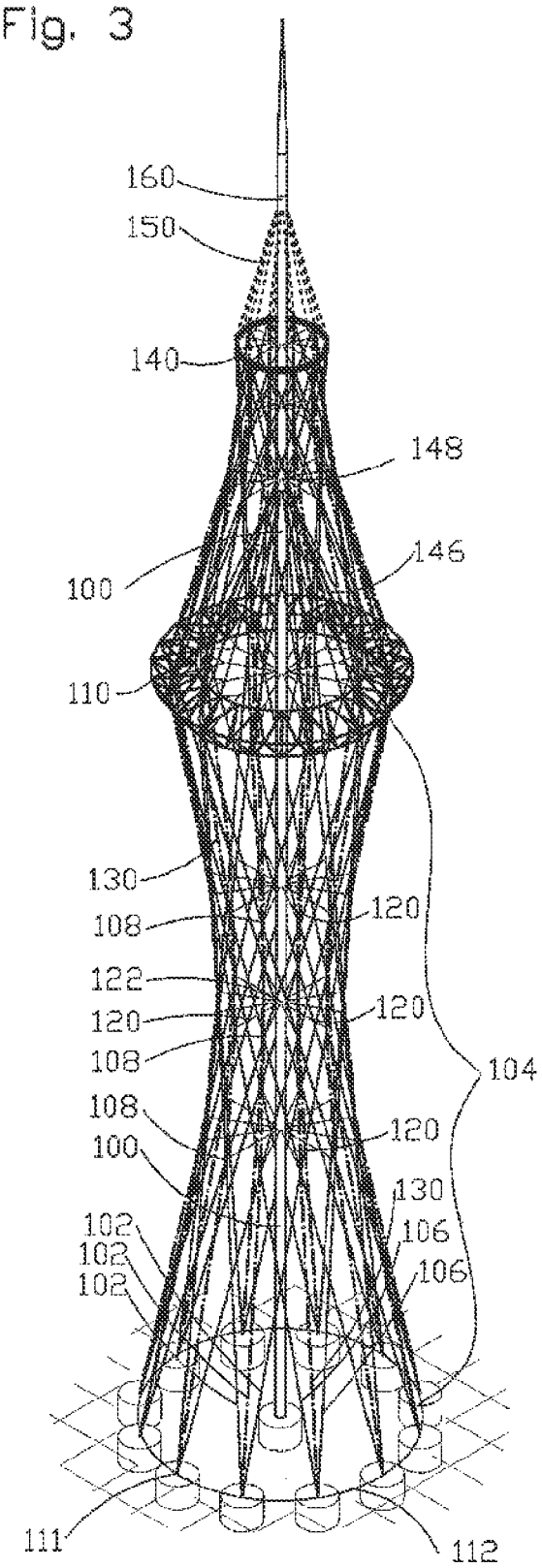
FIG. 3 is a simplified pictorial view of the mast and hyperbolic structure elements, the junction-to-mast joining elements and the junction-to-junction joining elements of the tower structure of FIGS. 1A & 1B.

Reference is now made to FIGS. 1A and 1B, which are simplified respective pictorial and side view illustrations of a tower structure constructed and operative in accordance with a preferred embodiment of the present invention, to FIG. 2, which is a simplified pictorial view illustration of the mast and hyperbolic structure elements and the junction-to-mast joining elements of the tower structure of FIGS. 1A and 1B, and to FIG. 3, which is a simplified pictorial view illustration of the mast and hyperbolic structure elements, the junction-to-mast joining elements and the junction-to-junction joining elements of the tower structure of FIGS. 1A & 1B.

As seen in FIGS. 1A and 1B, the tower structure preferably comprises a vertically oriented central mast 100, preferably a steel pipe of diameter five meters, wall thickness 10 centimeters and height 600 meters. As will be described hereinbelow, the central mast 100 is maintained under compression.

In accordance with a preferred embodiment of the present invention, a plurality of tensioned elongate elements, generally designated by reference numeral 102, are arranged to support the mast 100 against horizontal forces, such as wind forces and earthquake forces, and buckling. The plurality of tensioned elements 102 together define a generally hyperboloid structure 104.

The plurality of tension elongate elements 102 preferably include a first plurality of tensioned elongate elements 106, which are generally straight and define a multiplicity of junctions 108 therebetween. The plurality of tensioned elongate elements 106 are each anchored at a lower end thereof, preferably onto a structurally secure anchoring foundation and are attached at an upper portion thereof to a ring truss structure 110. Typically about 48 tensioned elongate elements 106 are provided and are anchored in pairs at 24 anchoring foundation locations 111 distributed along a horizontal circle 112 centered about mast 100 and having a radius of approximately 50 meters. It is appreciated that for the sake of clarity, the drawings show a lesser number of tensioned elongate elements 102.

Each pair of tensioned elongate elements 106 includes a left tensioned elongate element 106 which extends upwardly and to the left of mast 100 and a right tensioned elongate element 106 which extends upwardly and to the right of mast 100. The azimuth of the anchoring foundation location 111 in a plane perpendicular to mast 100 and centered on mast 100 preferably differs from the azimuth of the attachment location on ring truss structure 110 in a parallel plane thereto by 120 degrees.

It is a particular feature of the present invention that a plurality of junction-to-mast joining tensioned elongate elements 120 join at least some of the multiplicity of junctions 108 to the central, vertical mast 100. Preferably multiple, azimuthally distributed junction-to-mast joining tensioned elongate elements 120 extend in the same plane at a plurality of vertical locations 122 along mast 100. Preferably tensioned elongate elements 120 extend generally, but not precisely, radially outwardly from mast 100.

It is a particular feature of the present invention that the plurality of tension elongate elements 102 includes a third plurality of junction-to-junction joining tensioned elongate elements 130, which are connected at a plurality of mutually spaced fixed locations therealong to a corresponding plurality of junctions 108, typically less than all of junctions 108 and preferably one-half of all junctions 108. Preferably, each of junction-to-junction joining tensioned elongate elements 130 extends upwardly in a vertical plane, in which extends mast 100, from an anchoring foundation location 111 at least to an attachment location at ring truss structure 110 and is connected to a pair of intersecting tensioned elongate elements 106 at each of a plurality of junctions 108 lying along its path. The azimuth of the anchoring location 111 of each of junction-to-junction joining tensioned elongate elements 130 preferably is the same as the azimuth of the attachment location thereof on ring truss structure 110.

As seen in FIGS. 1A & 1B, the plurality of tensioned elongate elements 102, including tensioned elongate elements 106 and 130 or extensions thereof, also extend from ring truss structure 110 to a higher ring structure 140, on which may be mounted a spherical structure 142 or other suitable structure. The arrangement of the tensioned elongate elements 106 and 130 between ring truss structure 110 and ring structure 140 may be similar in all relevant respects to the arrangement of elongate elements 106 and 130 between the base and the ring truss structure 110.

Junction-to-mast joining tensioned elongate elements 120 are preferably provided at ring truss structure 110 and ring structure 140 and at locations therebetween. It is appreciated that additional ring structures (not shown) may also be provided.

In the illustrated embodiment, a plurality of cables 146 extend upwardly from the ring truss structure 110, to the mast 100 at a location 148 vertically spaced above ring truss structure 110, but below the top of the mast 100. Cables 146 preferably together define an overall conical configuration centered on mast 100.

In the illustrated embodiment, a plurality of cables 150 extend upwardly from the uppermost ring structure, here ring structure 140, to the mast 100 at a location 160 vertically spaced above ring structure 140, but typically below the top of the mast 100. Cables 150 preferably together define an overall conical configuration centered on mast 100.

Figure 4A:
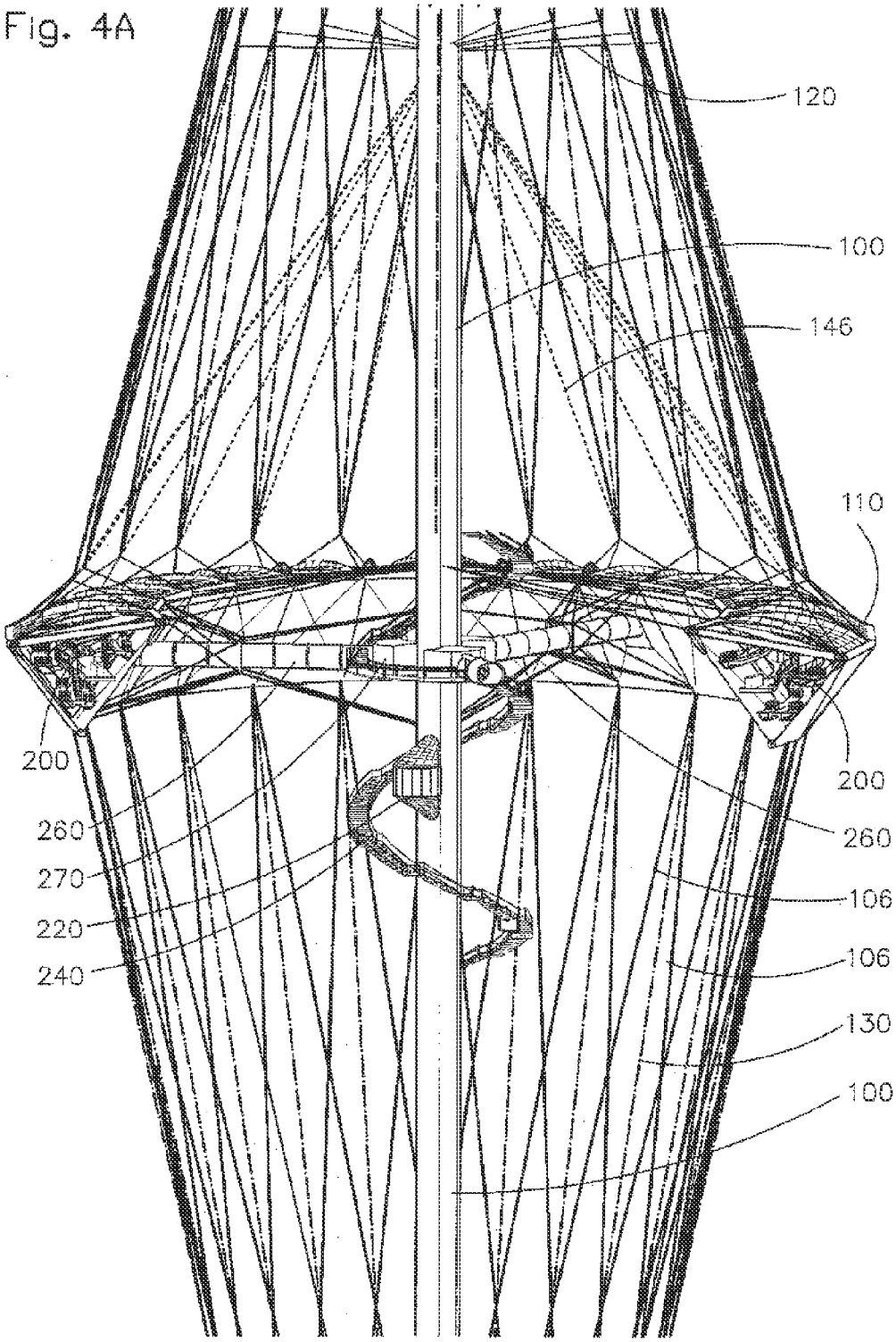
FIGS. 4A and 4B are simplified pictorial illustrations of part of the tower structure of FIGS. 1A & 1B including a multi-story restaurant facility in the shape of a ring.
Figure 4B:
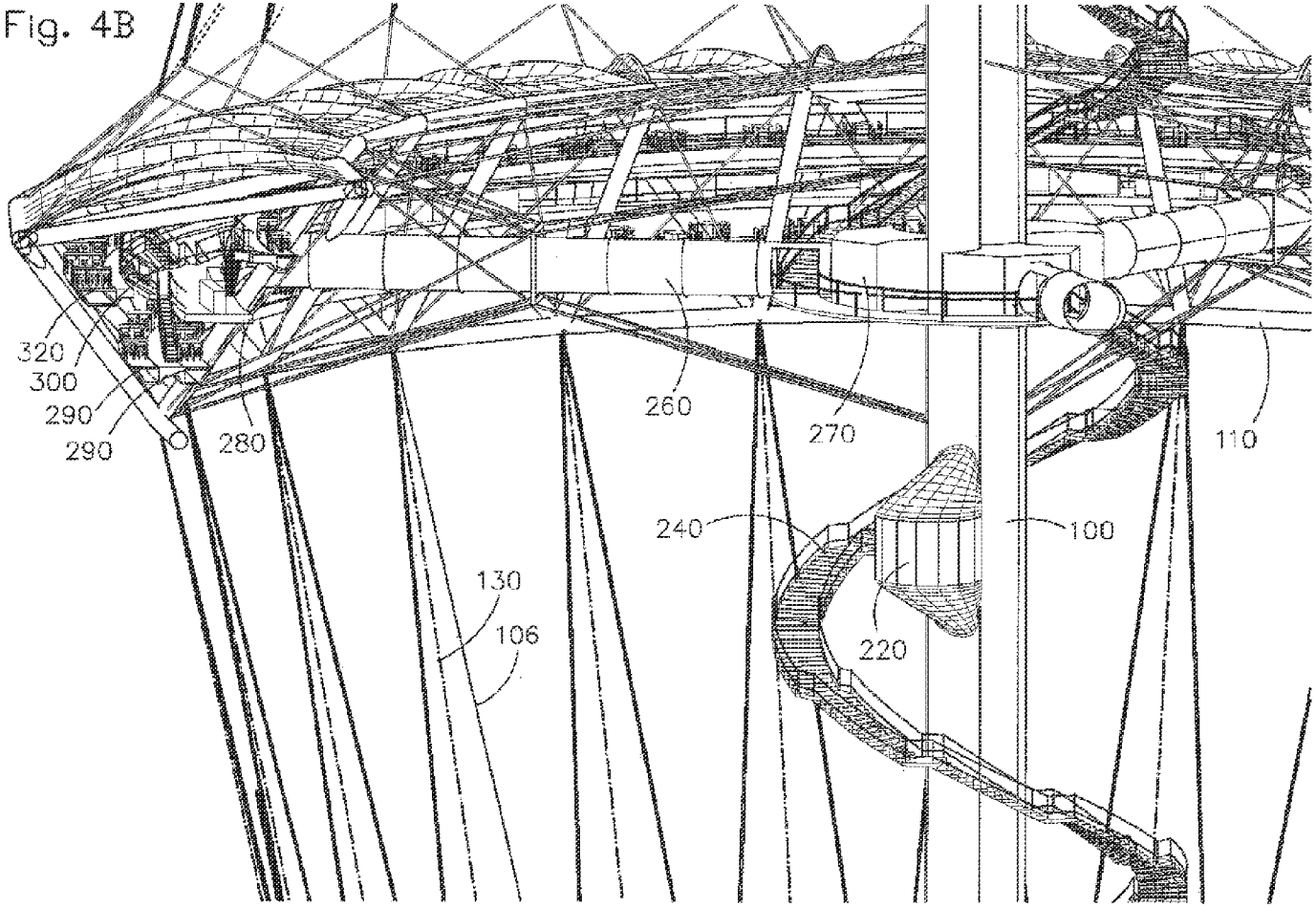

Reference is now made to FIGS. 4A and 4B, which are simplified pictorial illustrations of part of the tower structure of FIGS. 1A & 1B, including a multi-storey restaurant facility 200 having a ring configuration.

As seen in FIGS. 4A and 4B, which illustrate the restaurant facility 200 with respective lesser and greater amounts of detail, the restaurant facility 200 is preferably surrounded by the ring truss structure 110 and extends generally in a circle through 360 degrees in a plane perpendicular to mast 100. The ring configuration of the restaurant facility provides both interior facing and exterior facing views for a very large number of diners and may include seating at multiple levels, as shown. The interior views include views of substantially the entire restaurant facility and the ring truss structure 110 as well as of the various tensioned elements 106,120 and 130. The restaurant facility may be accessed via elevators 220 riding along tracks formed on outside surfaces of mast 100 and by stairways 240 which wind around the mast 100. Radial passageways 260 preferably interconnect an elevator and stairway lobby 270 with the restaurant facility 200.

In the illustrated embodiment, four 360 degree ring platforms, respectively designated by reference numerals 280, 290, 300 and 320 are provided. Preferably, platform 280 is stationary and at least part of each of the remaining platforms 290, 300 and 320 are driven in 360 degree motion in a horizontal plane about mast 100.

Figure 6A:
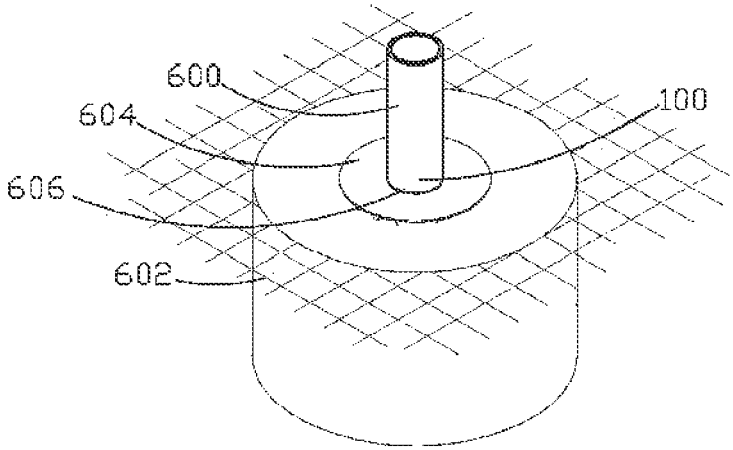
FIGS. 6A-6PP are simplified pictorial illustrations of multiple stages in construction of the tower structure of FIGS. 1A-4B.
Figure 6B:
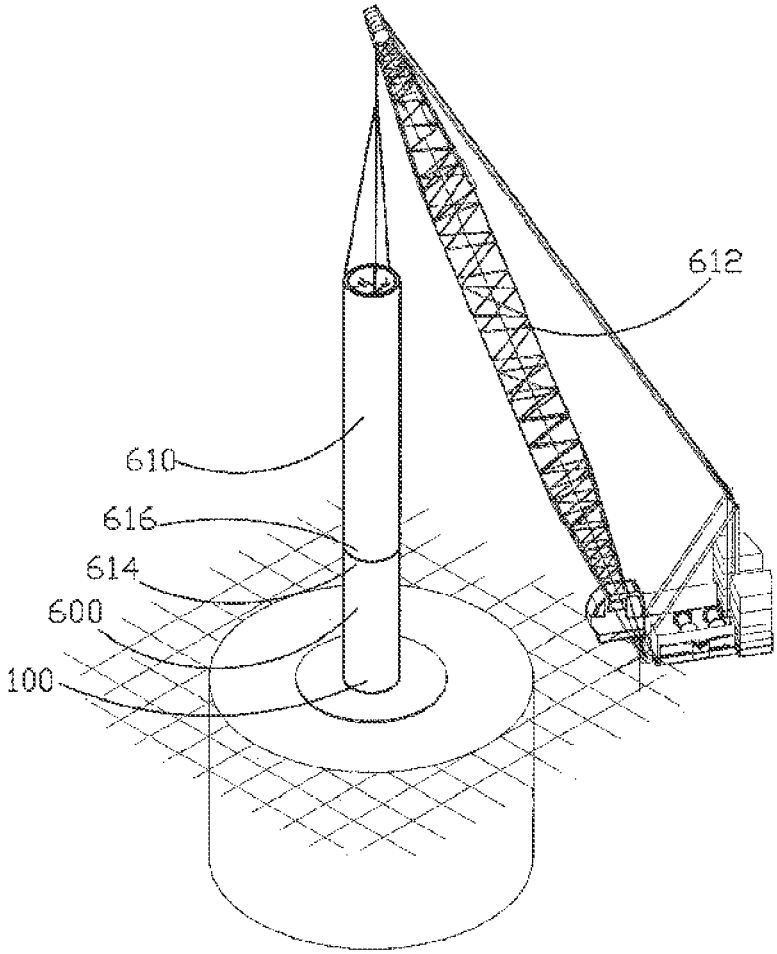
Figure 6C:
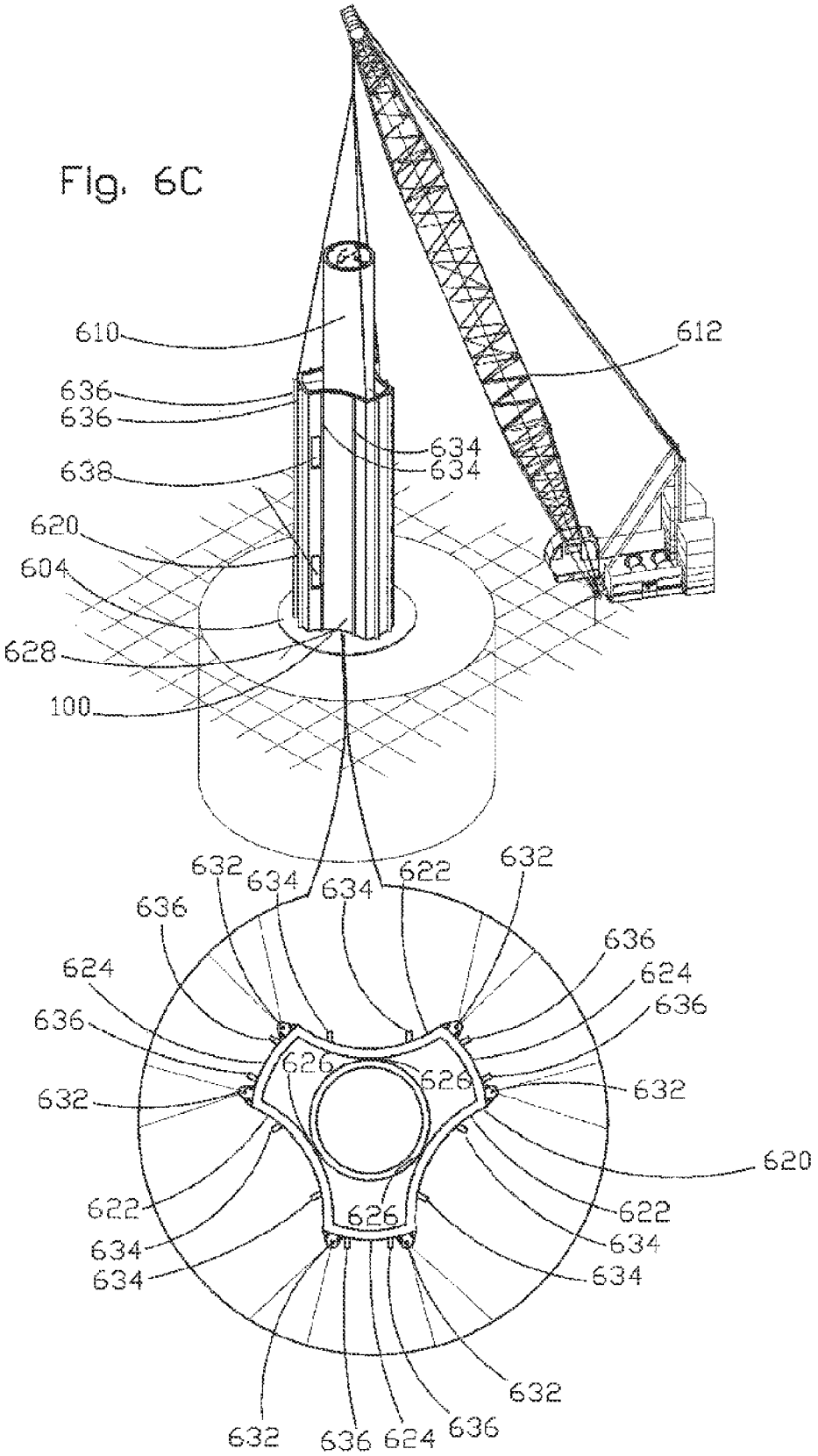
Figure 6D:
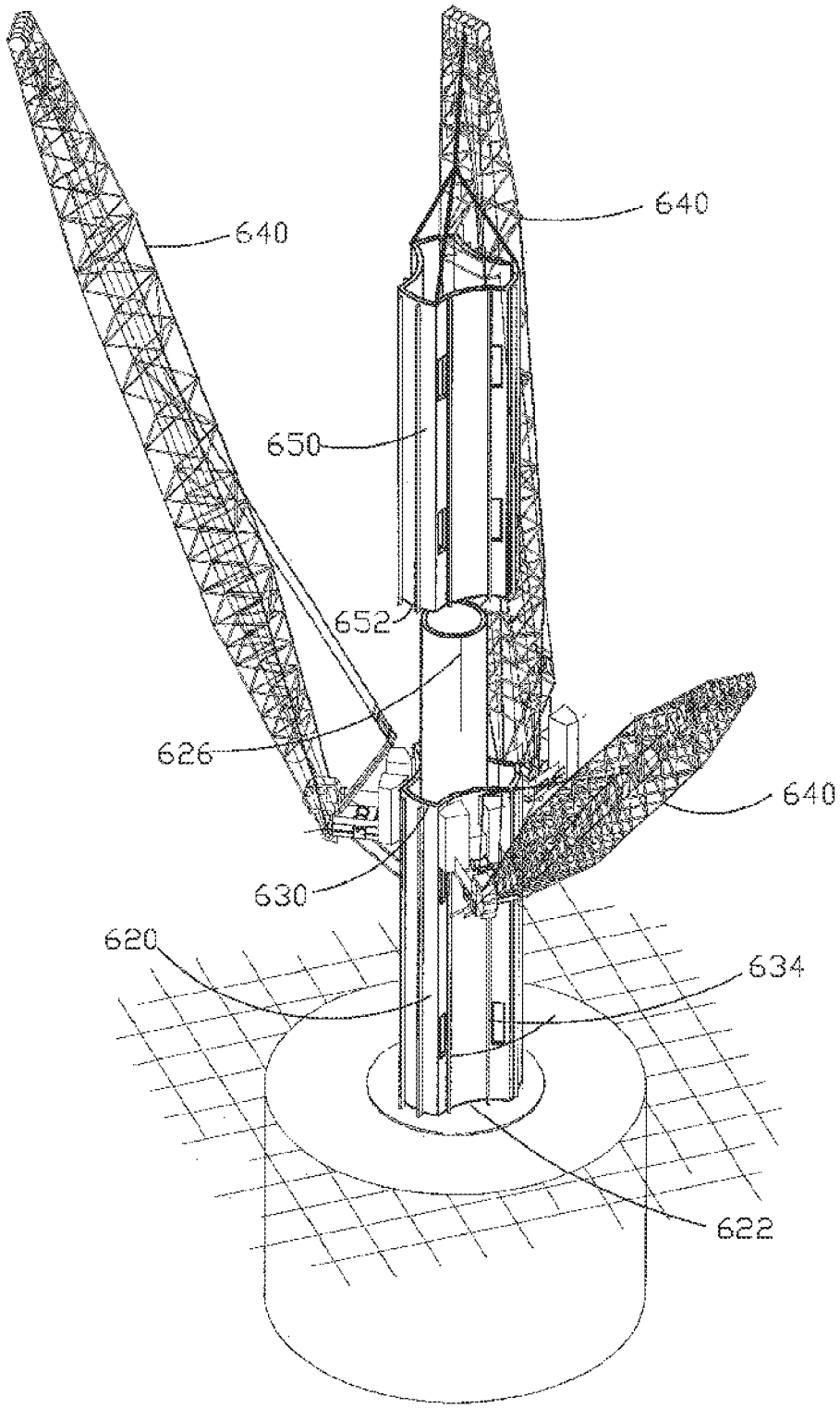
Figure 6E:
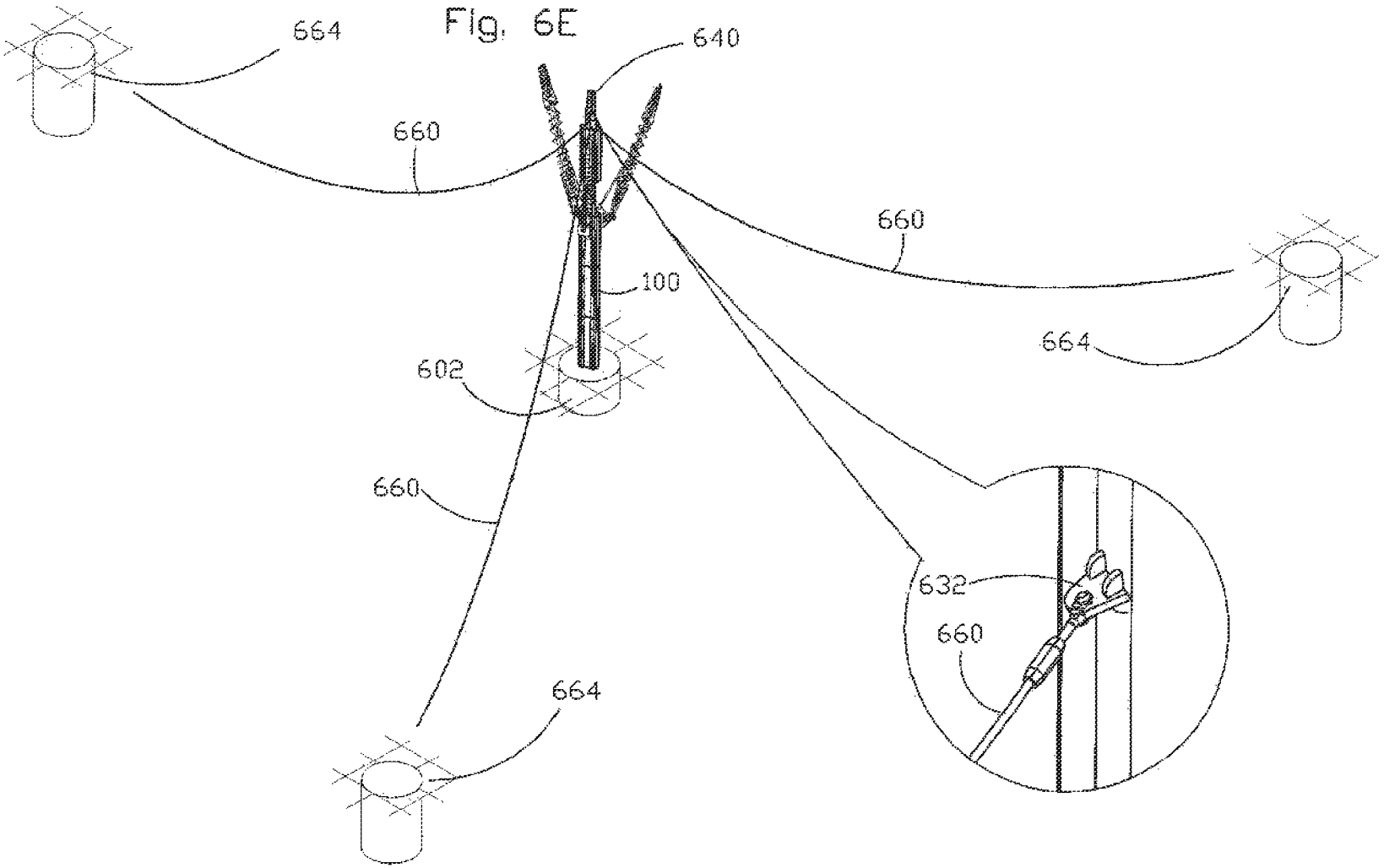
Figure 6F:
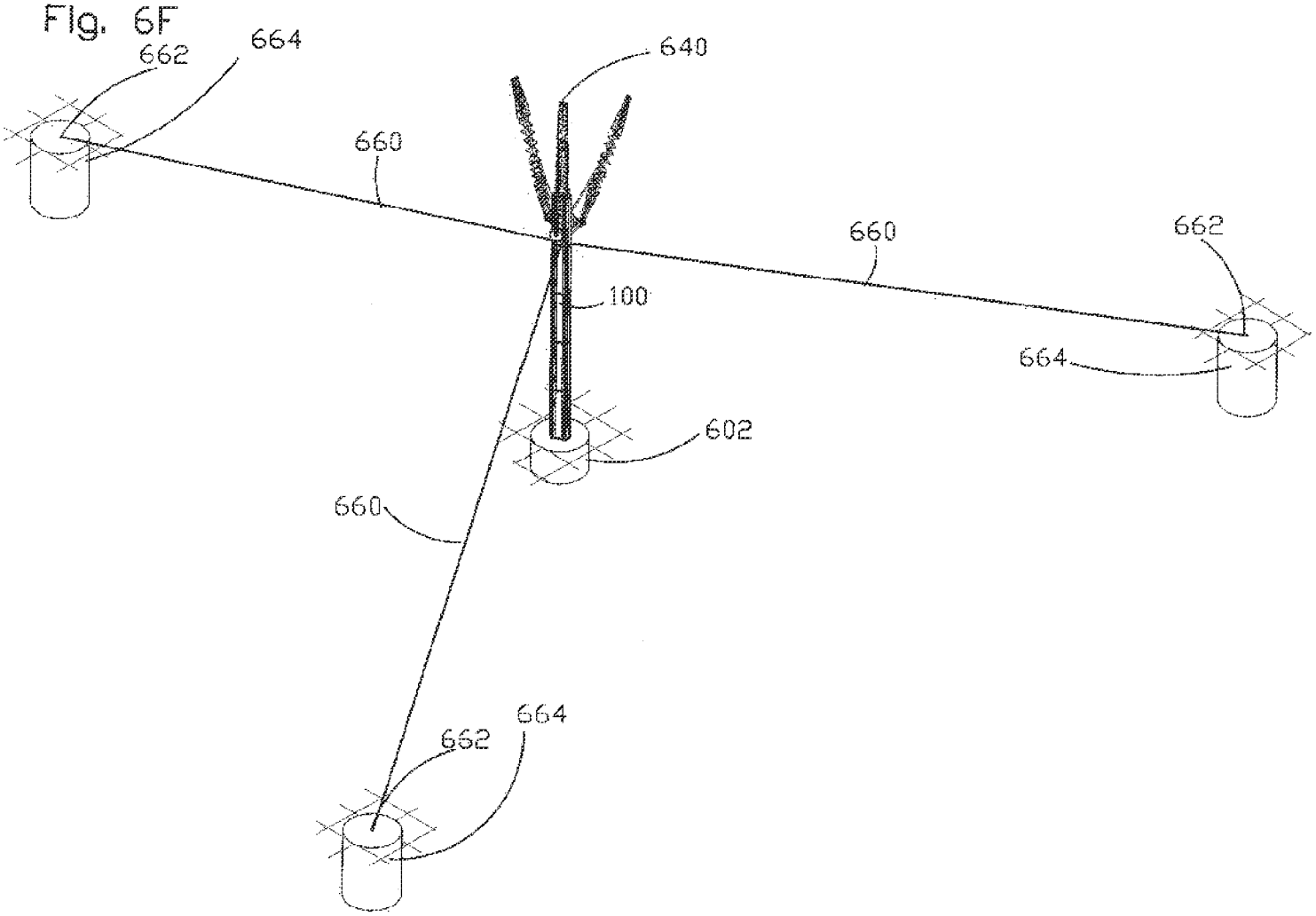
Figure 6G:
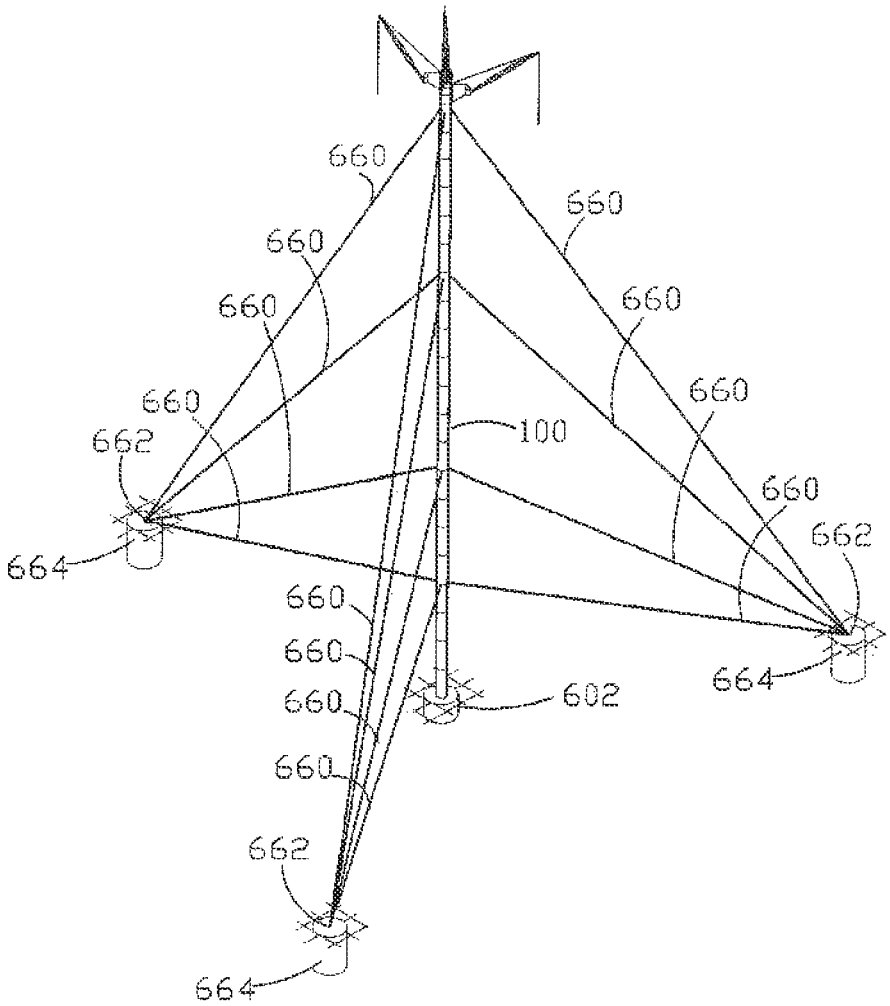
Figure 6H:
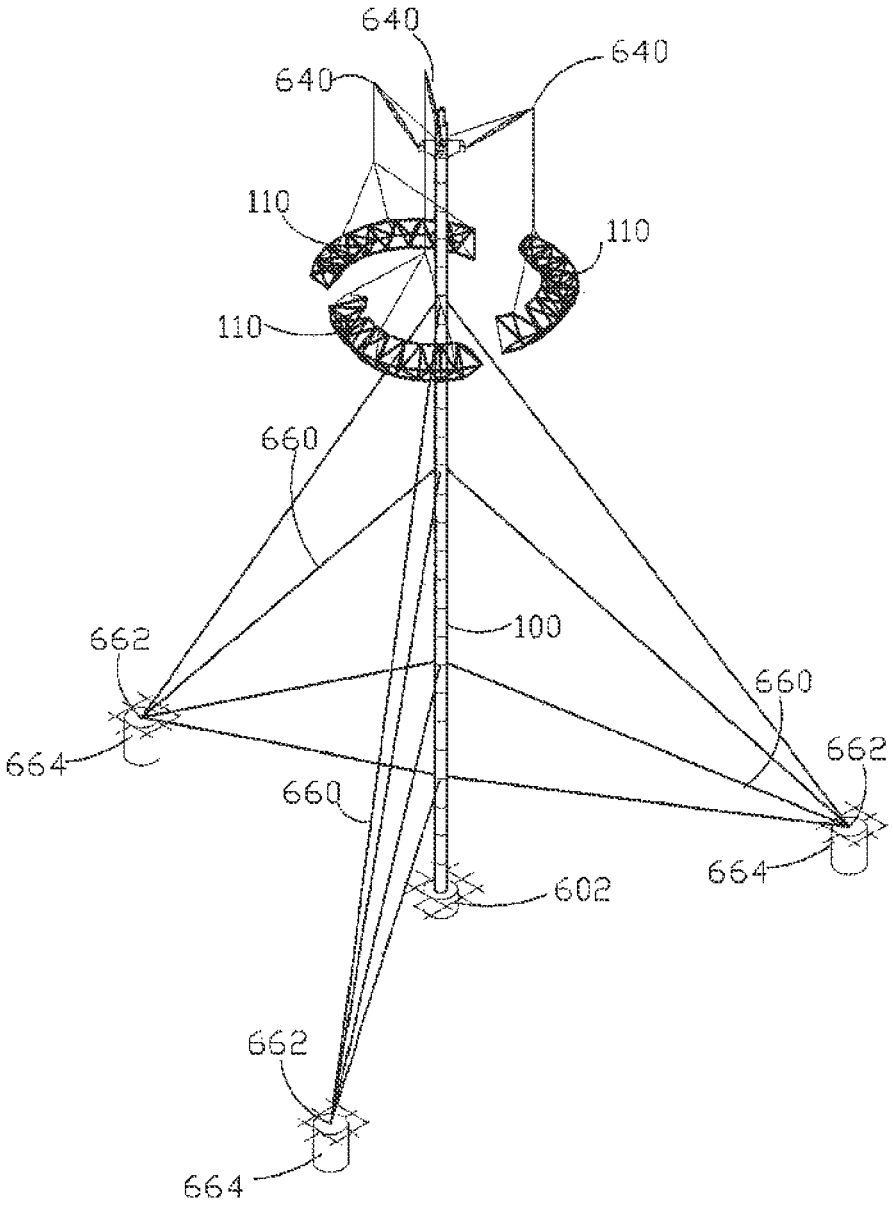
Figure 6I:
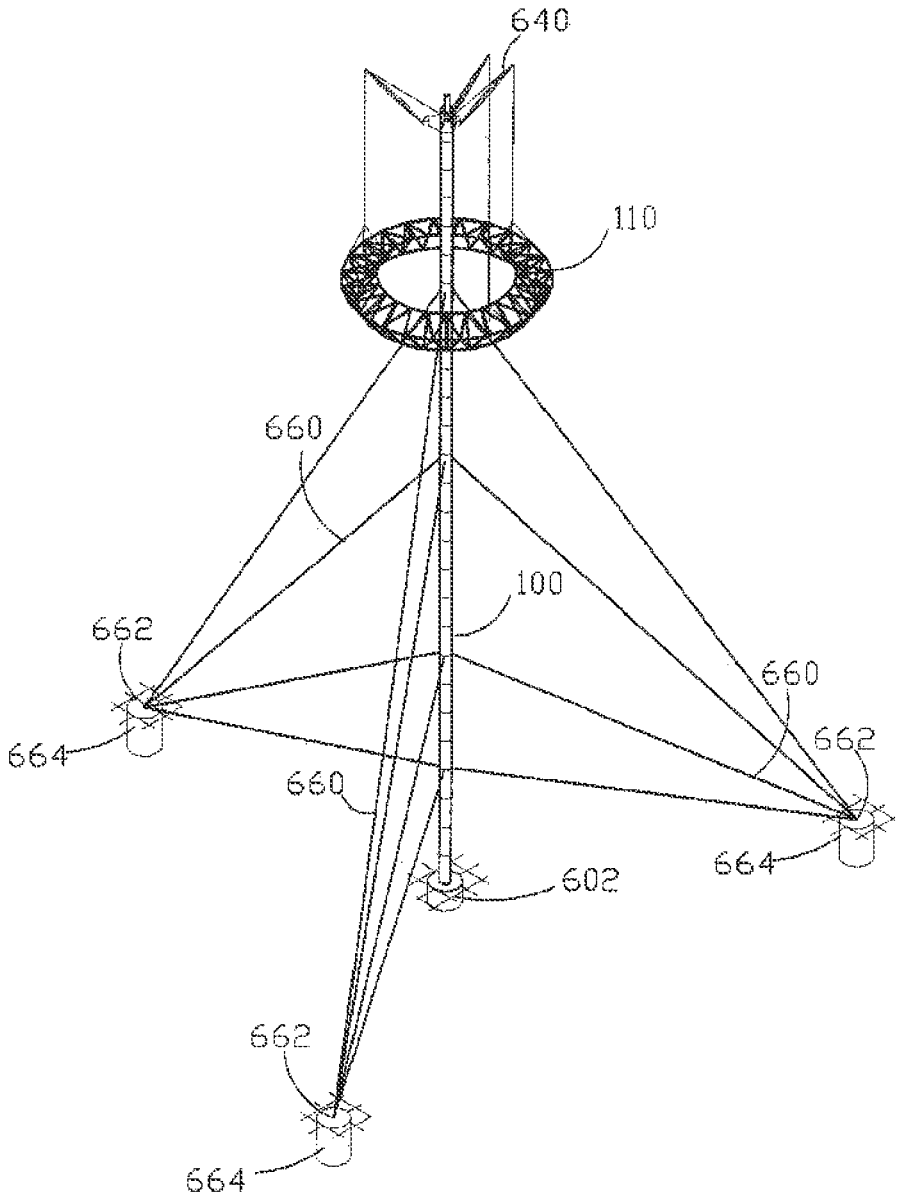
Figure 6J:
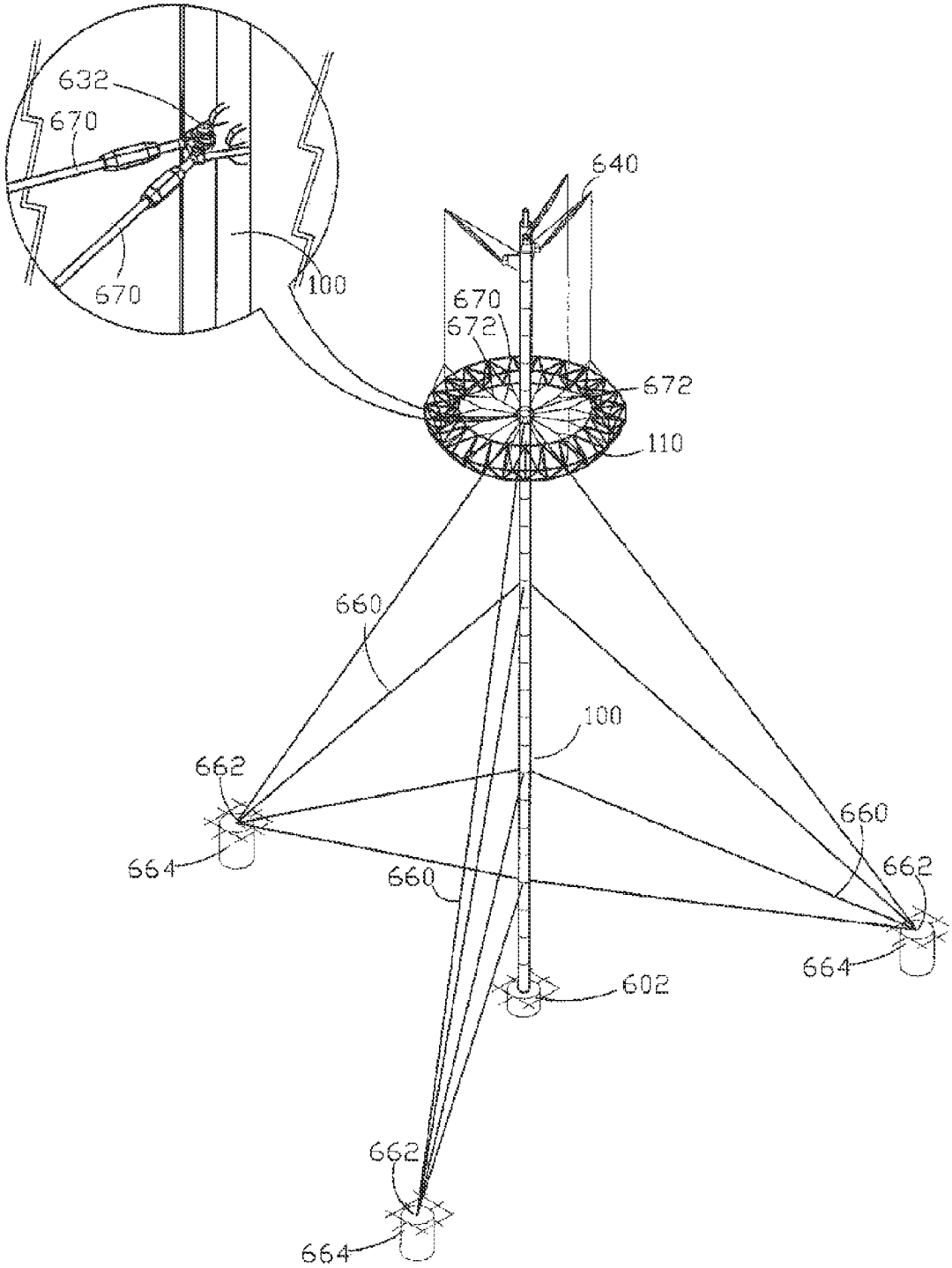
Figure 6K:
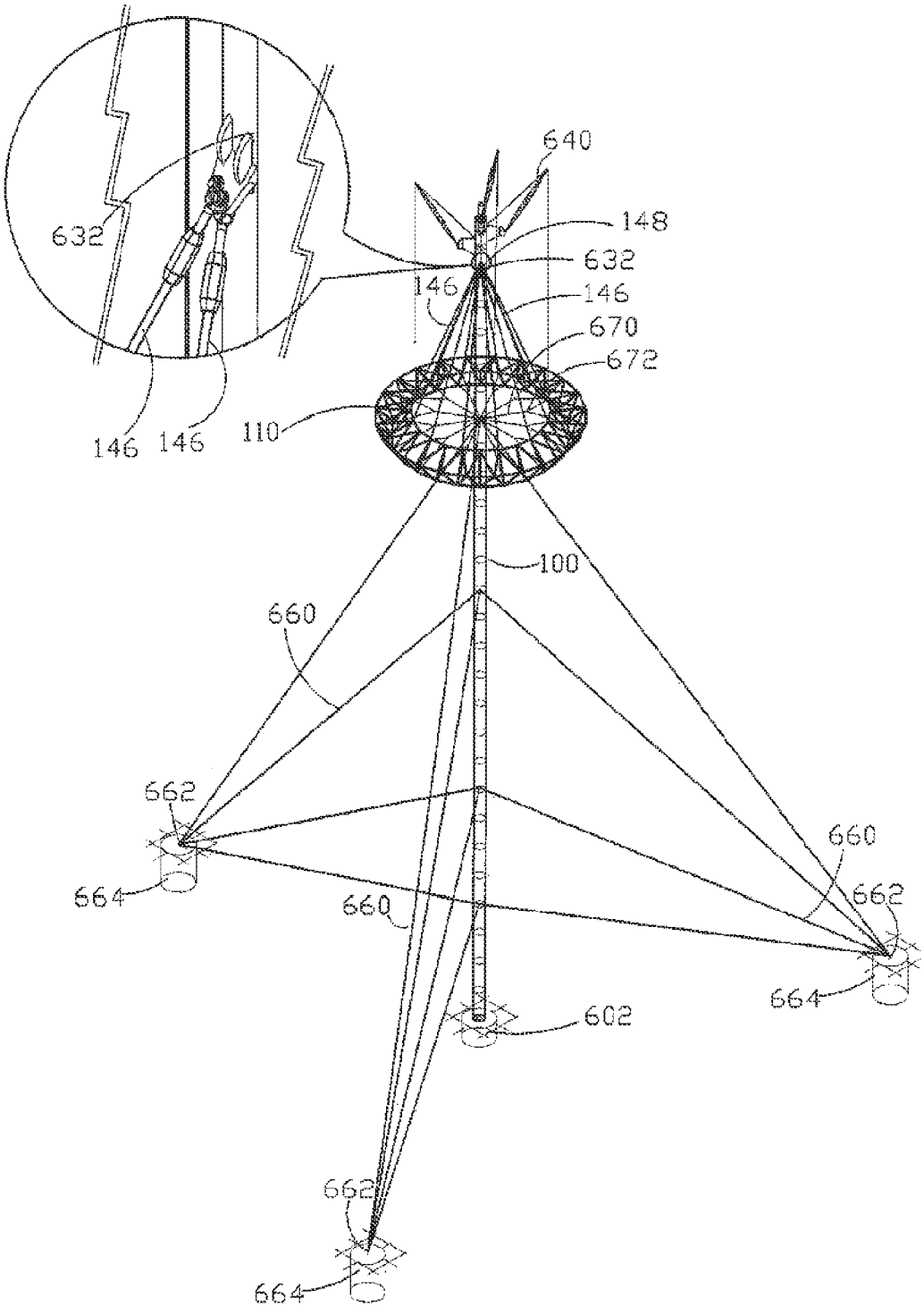
Figure 6L:
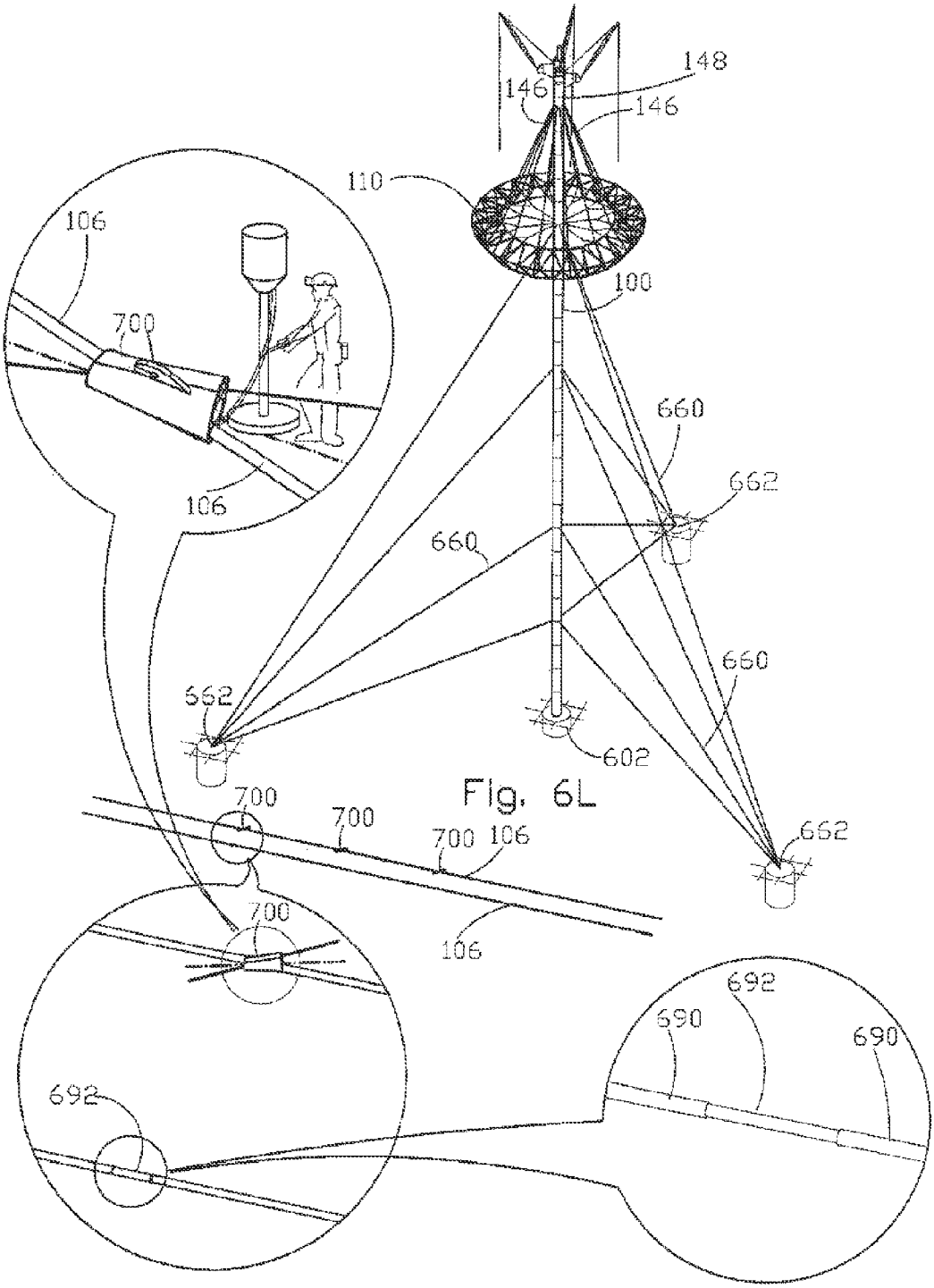
Figure 6M:
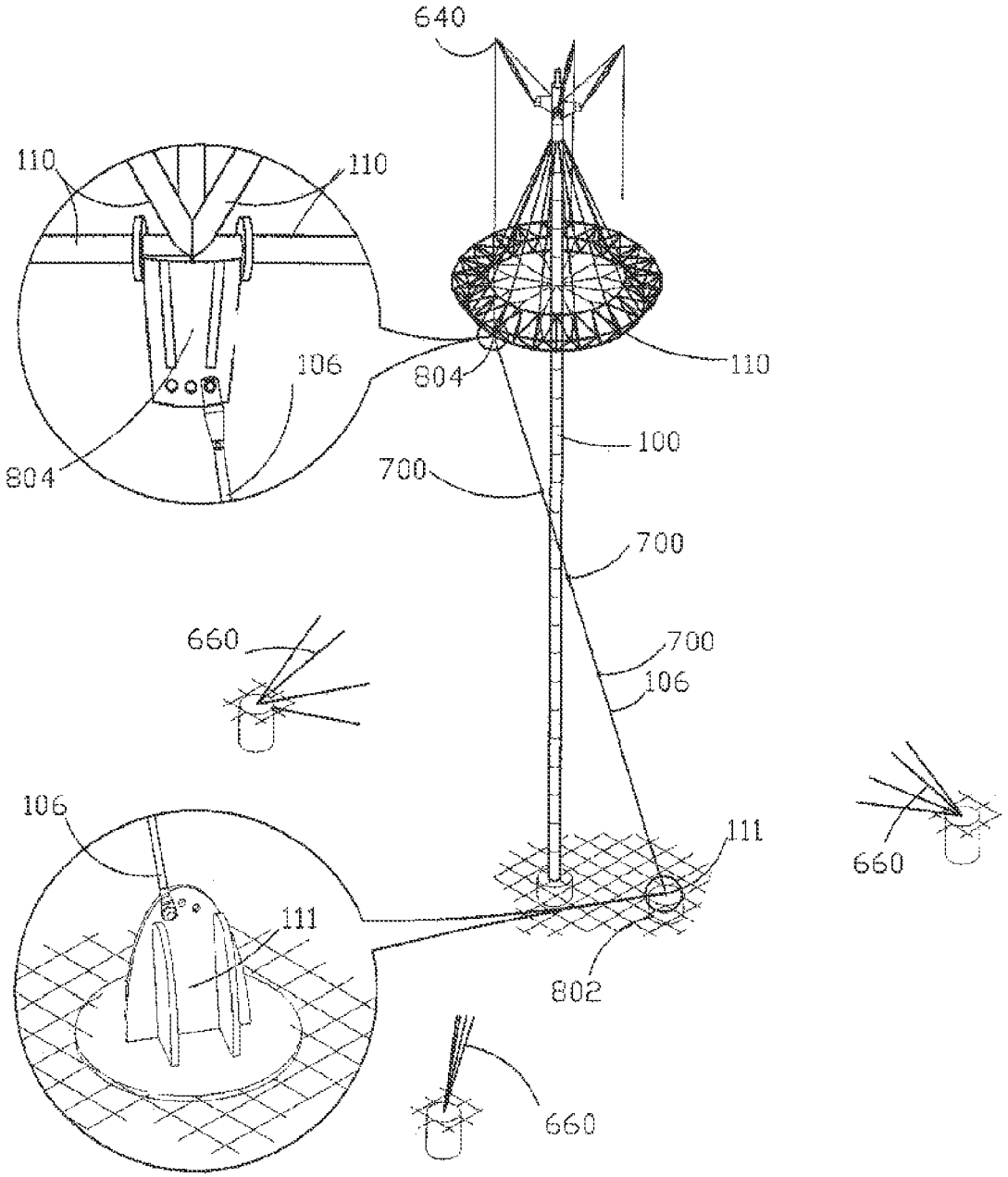
Figure 6N:
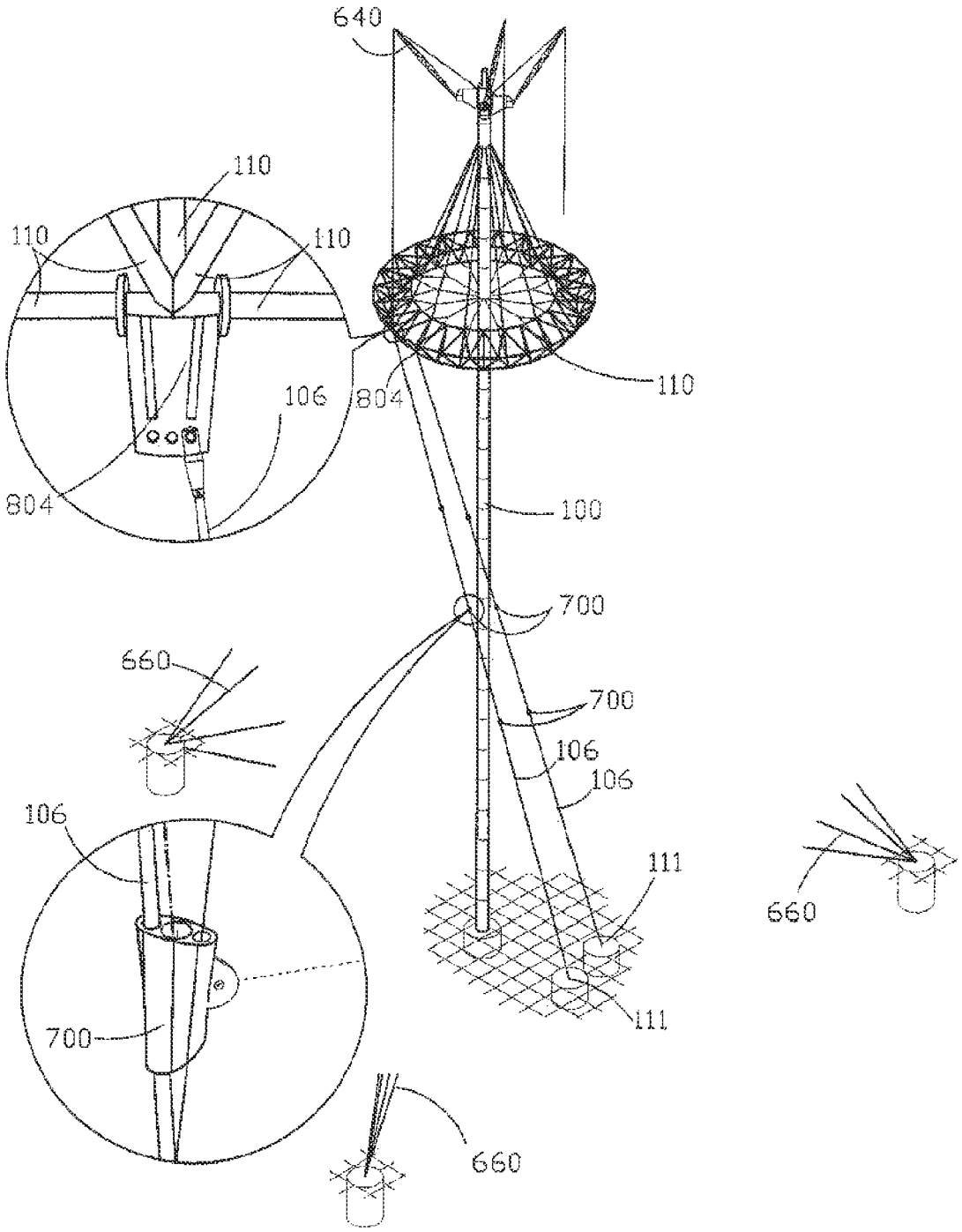
Figure 60:
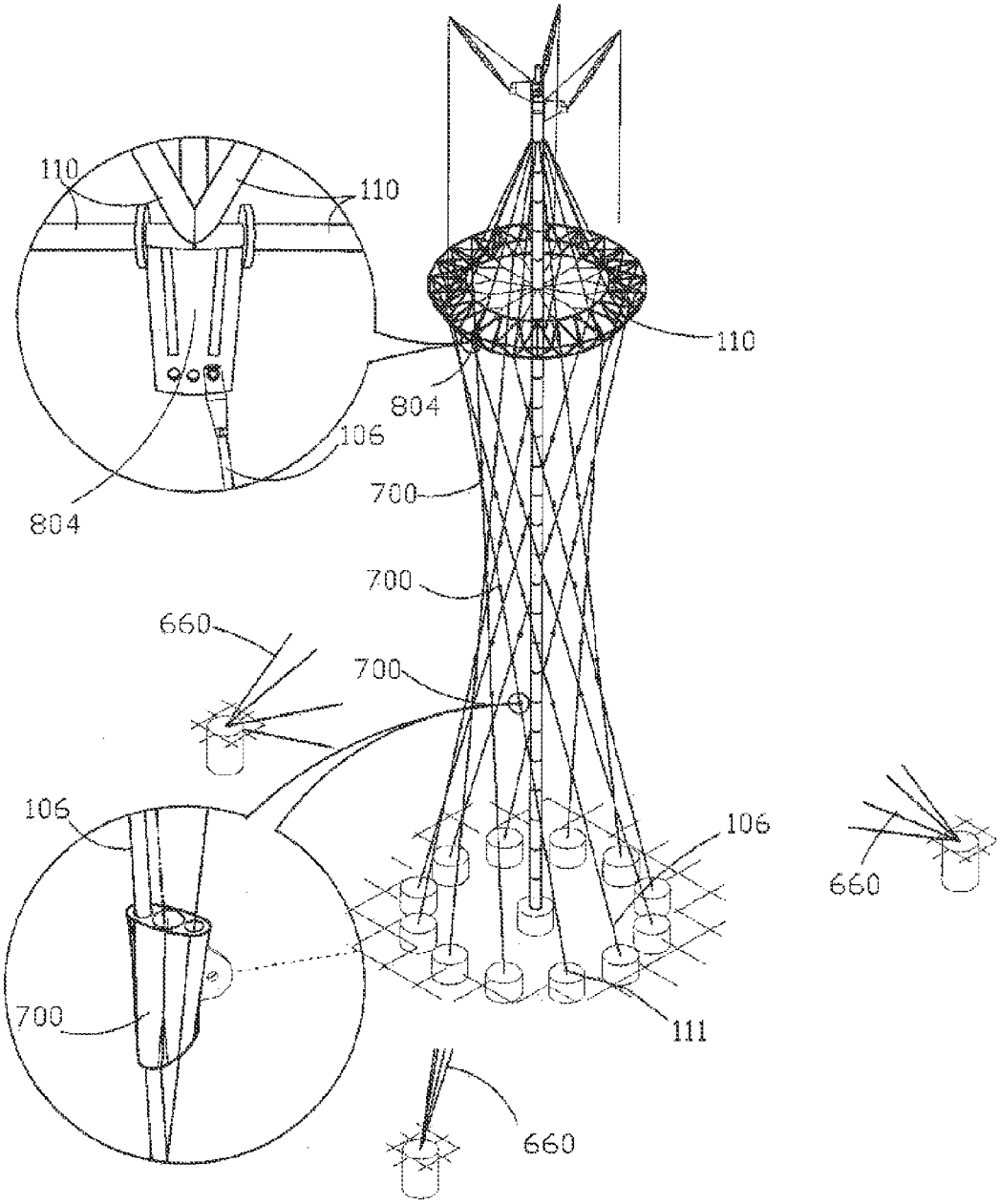
Figure 6P:
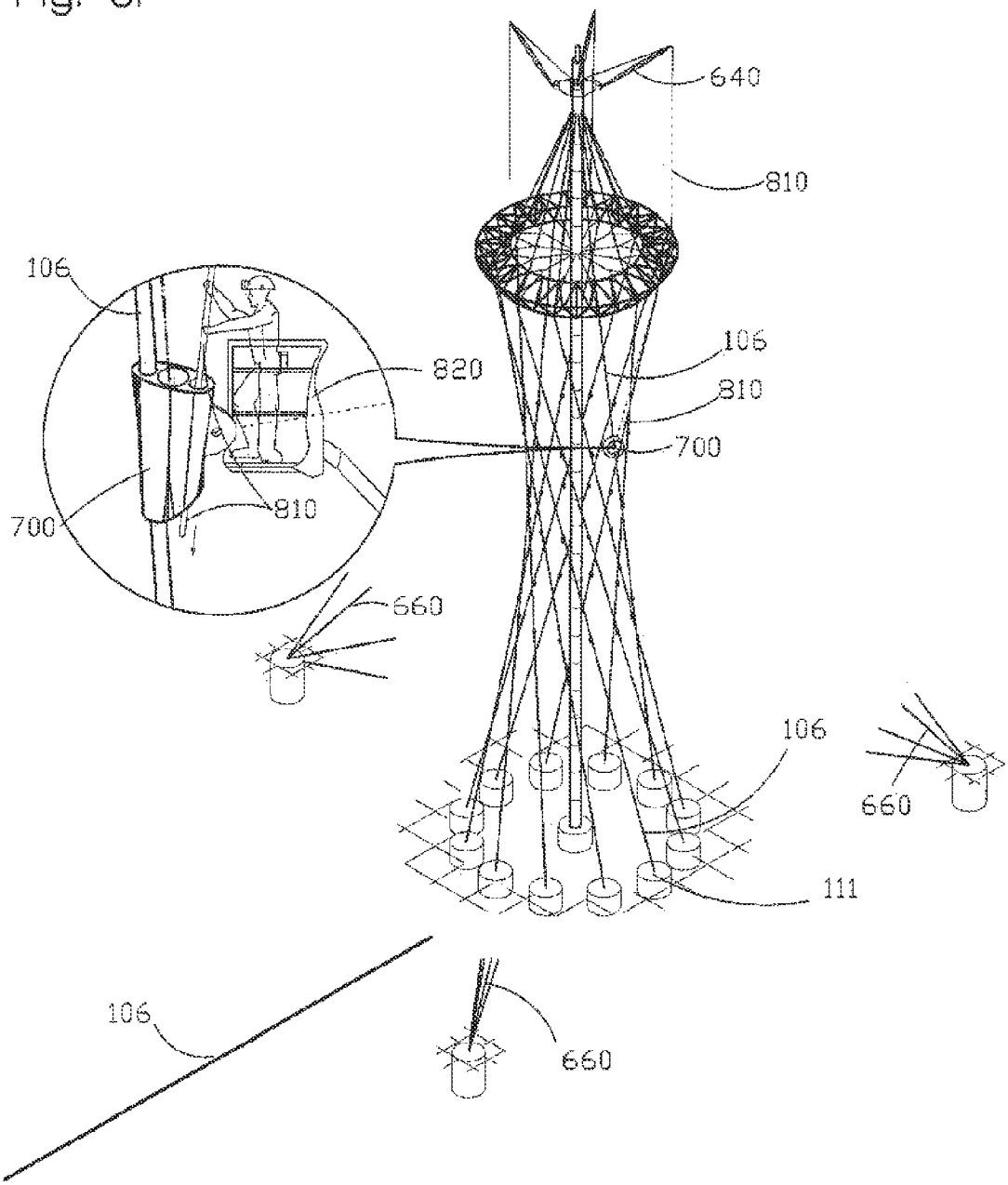

Reference is now made to FIGS. 6A-6PP, which are simplified illustrations of a preferred manner of construction of a preferred embodiment of the present invention.

Turning initially to FIG. 6A, there is seen a first internal section 600 of mast 100 which is arranged in an upstanding arrangement and supported onto a suitable foundation 602 onto which is formed a steel plate 604 which is anchored onto the foundation 602. A bottom circumferential edge 606 of first internal section 600 is preferably welded to the steel plate 604. Section 600 of mast 100 is preferably made of FE-52 steel and preferably has a thickness of 10 cm, an outer diameter of 250 cm and a height of 7.5 meters.

Turning to FIG. 6B, it is seen that a second internal section 610 of mast 100, preferably made of FE-52 steel and having a thickness of 10 cm, an outer diameter of 250 cm and a height of 15 meters is positioned, as by a crane 612, such as a Terex HC275 crane, onto a top edge 614 of section 600 and is welded thereto at a bottom edge 616 of the second internal section 610.

FIG. 6C shows a first external section 620 of mast 100, which is positioned, as by crane 612, over the first and second internal sections 600 and 610 of mast 100. As seen in FIG. 6C, the first external section 620, as seen in section, preferably includes three generally identical concave portions 622 which are mutually separated by three generally identical convex portions 624. The configuration and size of the concave portions 622 define inwardmost vertical axes 626 which lie along an imaginary cylinder having an inner diameter which is just slightly larger than the outer diameter of first and second internal sections 600 and 610. The first external section 620 of mast 100 is welded to the first and second internal sections 600 and 610 of mast 100 preferably along vertical axes 626.

First external section 620 is preferably welded at a lower edge 628 thereof to steel plate 604 and is formed with apertured connectors 632 at each junction between a concave portion 622 and a convex portion 624. Each concave portion 622 is preferably formed with a pair of parallel vertically extending tracks 634 and each convex portion 624 is preferably formed with a pair of parallel vertically extending tracks 636. Preferably first external section 620 is formed with a plurality of human access apertures 638.

Turning now to FIG. 6D, it is seen that three vertical track climbing cranes 640 are positioned along tracks 634 formed on concave portions 622 and are employed to position a second external section 650 onto first external portion 620. Cranes 640 are preferably suitably modified Terex HC275 cranes. Second external section 650 may be identical in all relevant respects to first external section 620 and is preferably welded at a lower edge 652 to upper edge 630 of first external section 620 and along vertical axes 626 to plural internal sections of the mast.

The addition and welding of further internal and external mast sections as shown and described hereinabove is repeated until a mast height of about 75 meters is reached. At this point, which is illustrated in FIG. 6E, temporary stabilizing cables 660 are preferably preattached to some of apertured connectors 632 formed on the current topmost external section of the mast, prior to attachment of outer ends 662 thereof to attachment foundations 664.

FIG. 6F shows stabilizing cables 660 attached at the outer ends 662 to corresponding attachment foundations 664 and tensioned, thereby to temporary stabilize the partially constructed mast. FIG. 6G shows further construction of the mast, up to a height of approximately 400 meters, and employing additional temporary stabilizing cables 660, which are attached to the partially constructed mast, typically at heights of 75 meters, 150 meters, 250 meters and 350 meters.

Turning now to FIG. 6H, there is seen further construction of mast 100 in generally the same manner as described hereinabove, followed by simultaneous positioning of three truss sections of ring structure 110 (FIGS. 1A & 1B), which are preferably joined together as shown in FIG. 6I to define ring truss structure 110.

FIG. 6J shows attachment of a plurality of radial tension elements 670, such as rods or cables, between multiple connection locations 672 on ring truss structure 110 and apertured connectors 632 on mast 100 located generally in the same horizontal plane as locations 672. It is appreciated that the plurality of radial tension elements 670 are all preferably equally tensioned and all preferably lie in a single horizontal plane.

FIG. 6K shows a plurality of ring truss support elements 146 (FIGS. 1A & 1B) such as rods or cables, which are connected typically between connection locations 672 on ring truss structure 110 and apertured connectors 632 at a location 148 (FIGS. 1A & 1B) on mast 100, which location is approximately 75 meters above the horizontal plane of radial tension elements 670. At this stage, the ring truss structure 110 is supported by the mast 100 via ring truss support elements 146.

Turning now to FIG. 6L, there is seen preparation of tensioned elongate elements 106 (FIGS. 1A & 1B), which are preferably fabricated on site as bundles of parallel wires. It is seen that tensioned elongate elements 106 are preferably laid out on the ground and the bundles of wires are covered with a protective layer 690 other than at the intended locations 692 of junctions 108 (FIGS. 1A & 1B).

Multi-element connectors 700 are preferably threaded along each elongate element 106 and positioned therealong at the intended locations of junctions 108 and permanently fixed thereto.

Preferably, connectors 700 are permanently fixed to the tensioned elements 106 by pouring a bonding agent, preferably an alloy of tin and lead, into the interior spaces of connectors 700 which surround the tensioned elements 106. Hardening of the bonding agent bonds the tensioned elements 106 to connectors 700 and prevents relative motion therebetween.

Figure 5:
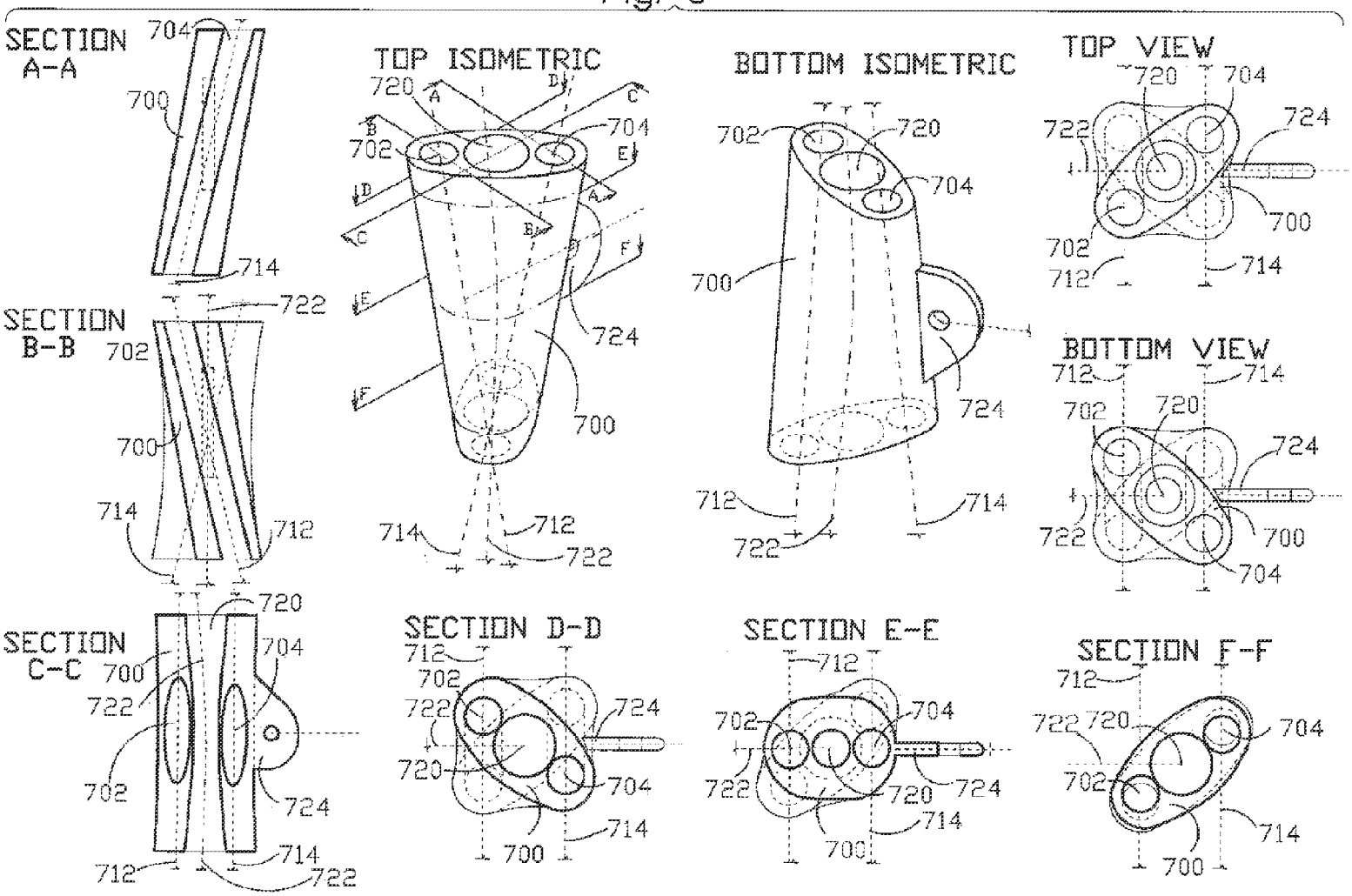
FIG. 5 is a composite illustration of a multi-element connector useful in the tower structure of FIGS. 1A-4B.

Reference is now made to FIG. 5, which illustrates a preferred embodiment of a connector 700. Connector 700 is preferably made of FE-52 steel and is formed with first and second bores 702 and 704 which are non-intersecting and which extend along respective bore axes 712 and 714 which are angularly separated from each other in two dimensions, such that bore axes 712 and 714 are not coplanar. Bores 702 and 704 are designed to accommodate tensioned elongate elements 106.

In accordance with a preferred embodiment of the present invention, a non-cylindrical passageway 720 is also formed in connector 700 and extends along an axis 722 and is designed to accommodate a tensioned elongate element 130. As seen clearly in FIG. 5, the cross section of non-cylindrical passageway 720 preferably has a generally curved hour-glass configuration. It is appreciated that the angular relationships between bores 702 and 704 and passageway 720 may vary for connectors 700 employed at different levels of the tower structure, in view of the different angular relationships between tensioned elements 106 and 130 thereat.

Further in accordance with a preferred embodiment of the present invention each connector 700 is provided with an apertured connector 724, which preferably lies in a vertical plane and is employed for attachment of a junction-to-mast joining tensioned elongate element 120 thereto, thereby to enable joining of the junctions 108, at which connectors 700 are provided, to the central, vertical mast 100.

Reference is now made to FIG. 6M, which is simplified for clarity by eliminating most of the stabilizing cables 660, which continue to be present, from the drawing. As seen in FIG. 6M, each tensioned elongate element 106, having fixed thereto connectors 700 at each of locations 108, is attached at one end thereof to a foundation 802 at an anchoring location 111 (FIGS. 1A & 1B) and is attached at an opposite end thereof to an apertured connector 804 formed on ring truss structure 110 (FIGS. 1A & 1B). FIG. 6M shows positioning and attachment of a first left tensioned elongate element 106 and FIG. 6N shows positioning and attachment of a second left tensioned elongate element 106. FIG. 6O shows positioning and attachment of all of the left tensioned elongate elements 106, typically 24 in number. For clarity, only 12 are shown. The connectors 700 are shown on each illustrated left tensioned elongate element.

Figure 6Q:
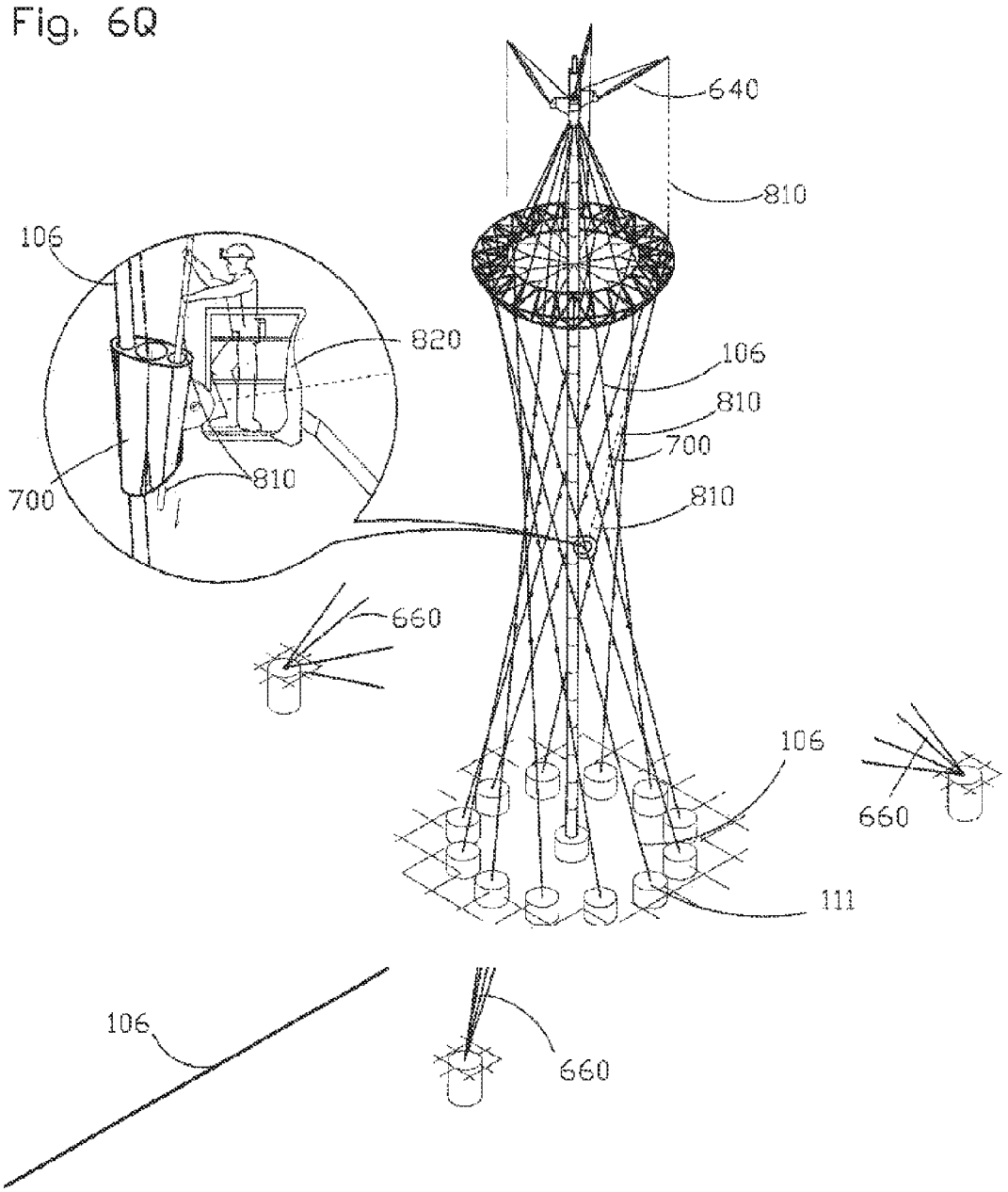

Turning now to FIG. 6P, there is seen a first step in positioning a first right tensioned elongate element 106. This is preferably done by lowering a first right tensioned elongate element lead wire 810 by means of crane 640 to a top most connector 700 on one of left tensioned elongate elements 106, which was already positioned and connected but preferably not yet tensioned. A human operator is preferably lowered on a platform 820 by another crane in order to thread the first right tensioned elongate element lead wire 810 initially through a topmost connector 700 on one of the left tensioned elongate elements 106 and thereafter through sequentially lower connectors 700 on other left tensioned elongate elements 110, as shown in FIG. 6Q.

Figure 6R:
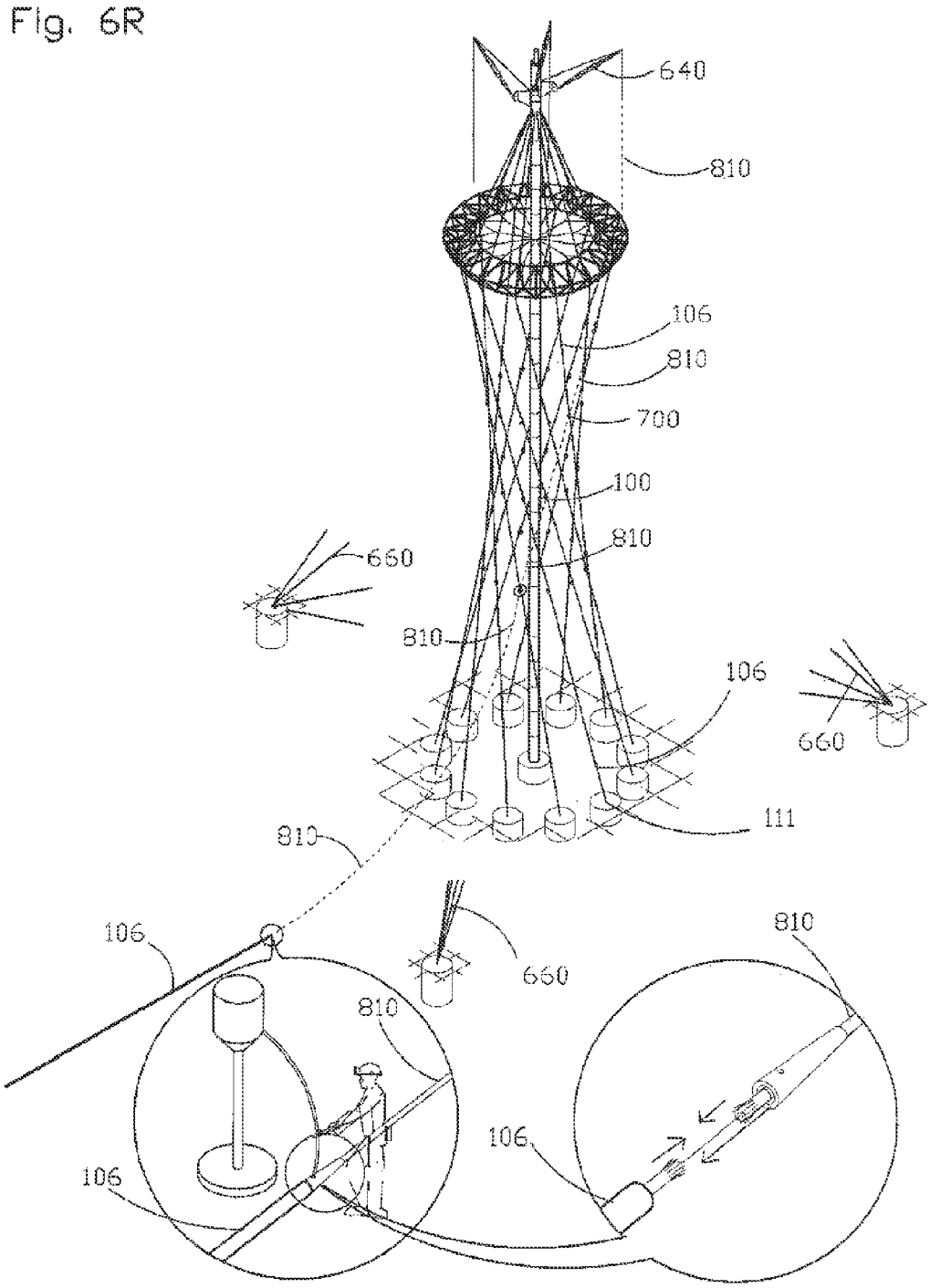

As shown in FIG. 6R, once the lead wire 810 has been threaded through all of the connectors 700 through which the right tensioned elongate element 106 is intended to extend, the lower end of the lead wire 810 is attached to a first end of a first right tensioned elongate element 106 preferably, using a bonding agent, preferably an alloy of tin and lead. Hardening of the bonding agent bonds the tensioned element 106 to the lead wire 810. It is appreciated that the opposite end of right tensioned elongate element 106 may be mounted onto a foundation at an anchoring location 111.

Figure 6S:
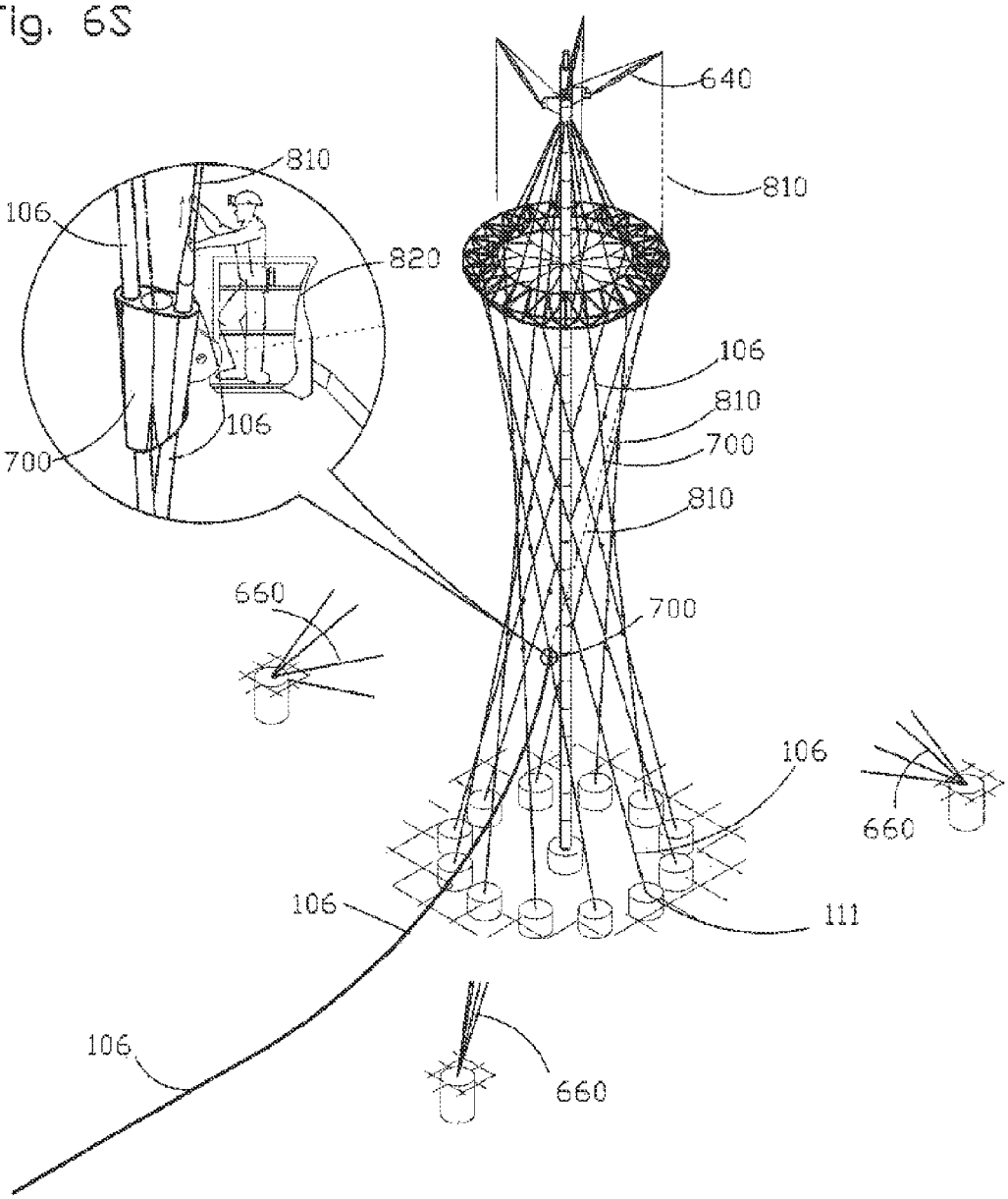
Figure 6T:
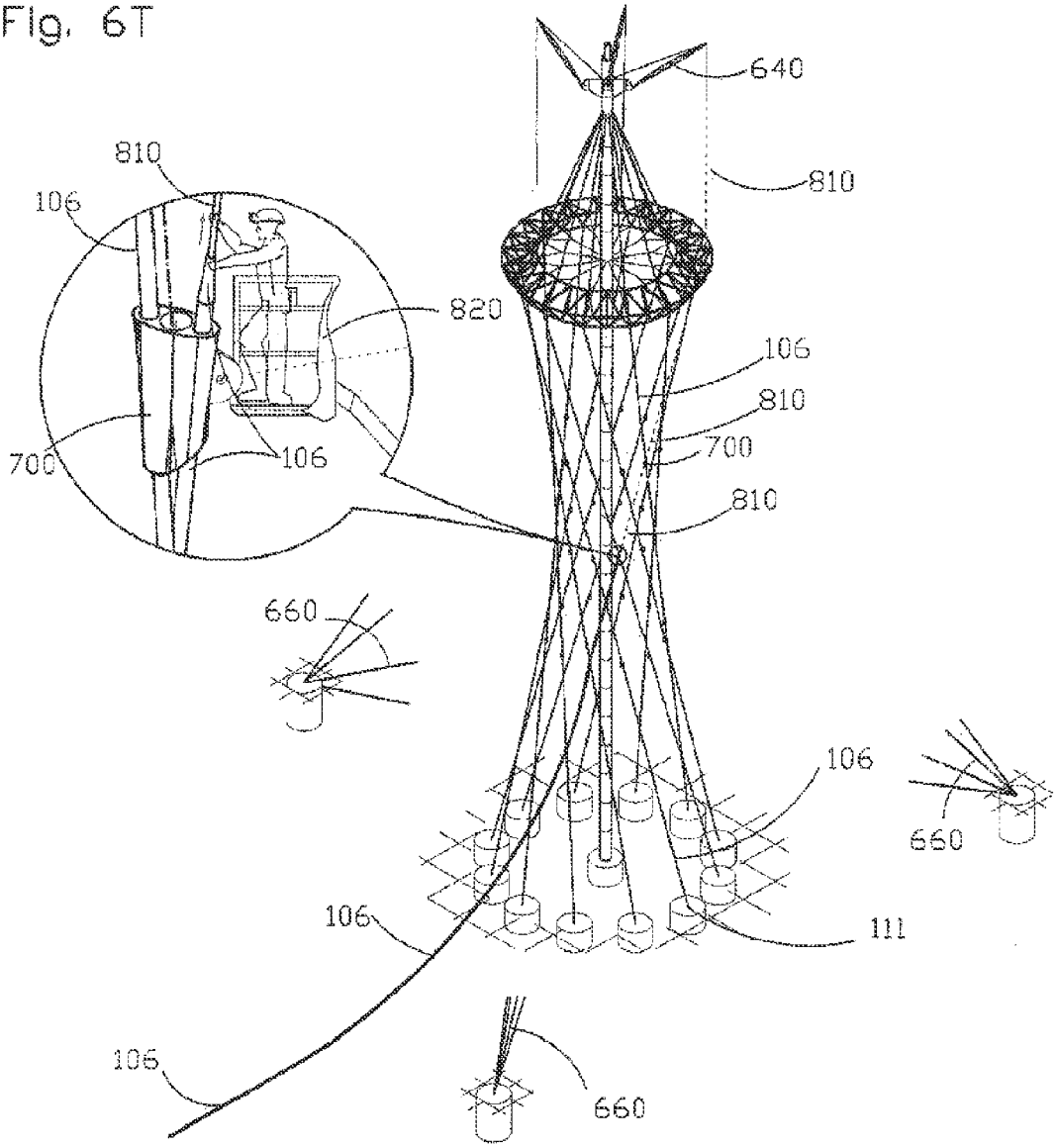
Figure 6U:
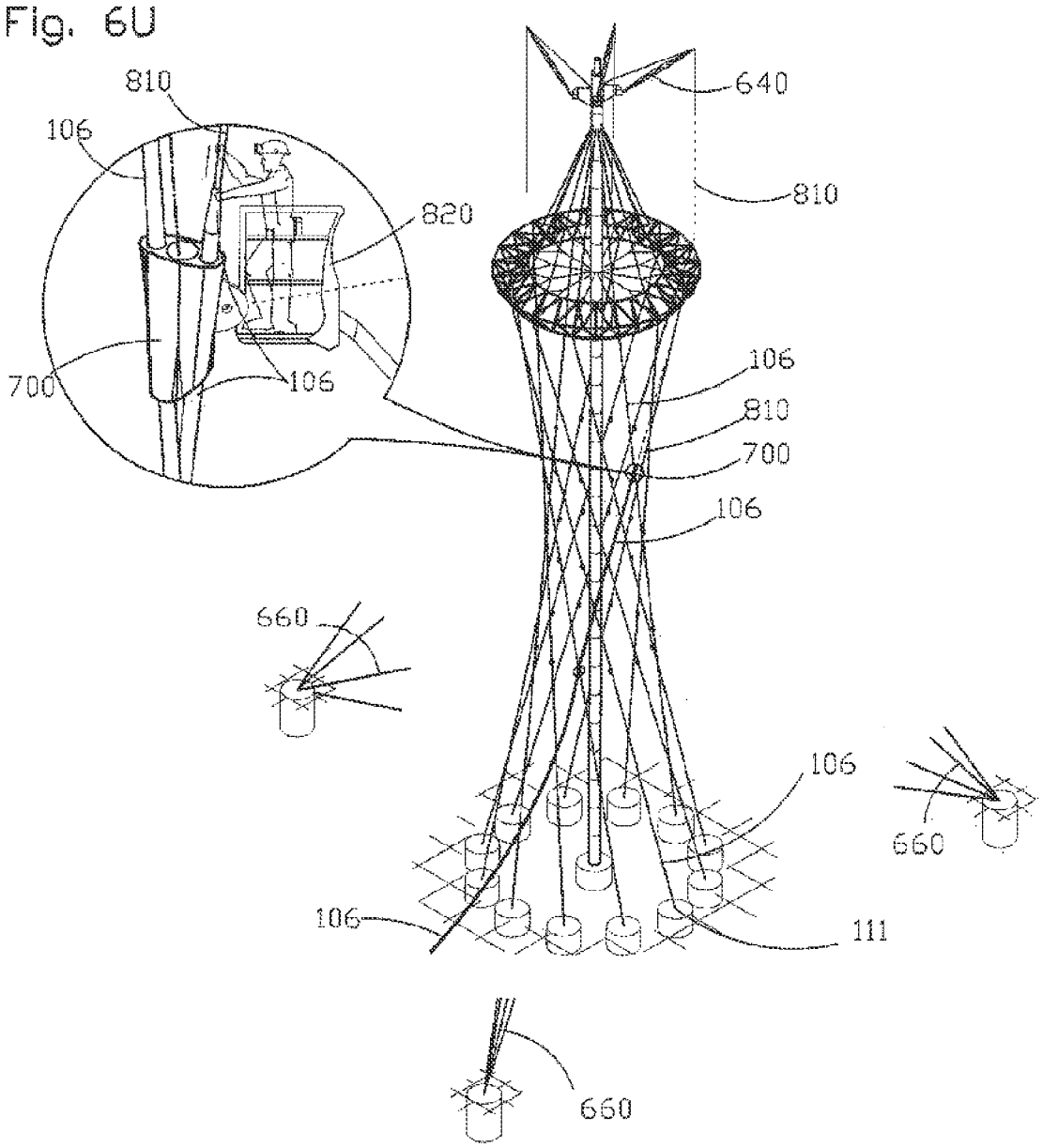
Figure 6V:
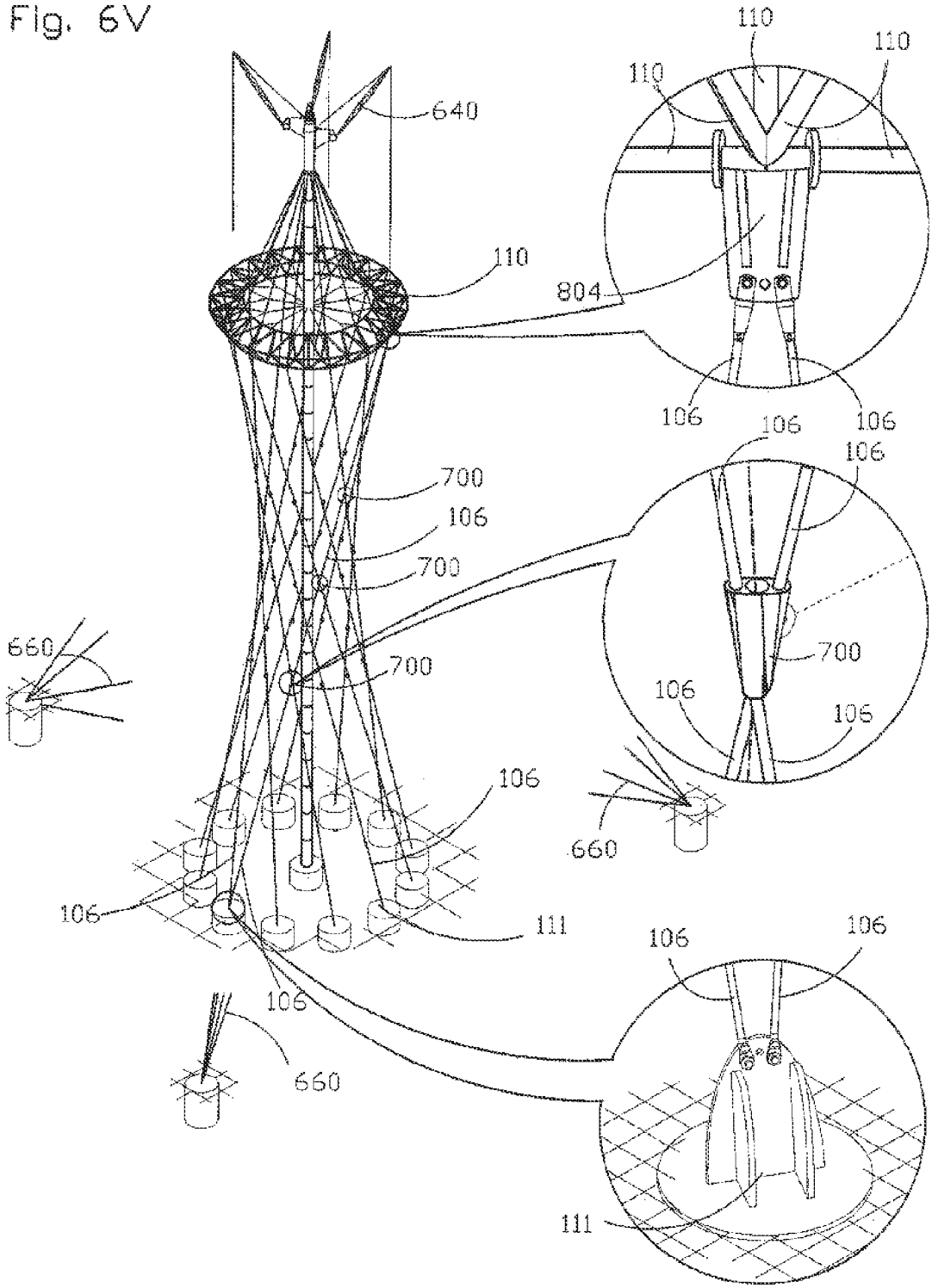

The lead wire 810 is then pulled upwardly so as to thread the first right tensioned elongate element 106 through the various connectors 700 through which the lead wire 810 was earlier threaded, possibly with the assistance of a human operator, as seen in FIGS. 6S, 6T and 6U. The upper end of the first right tensioned elongate element 106 is then attached to an apertured connector 804 formed on ring truss structure 110 (FIGS. 1A & 1B), as seen in FIG. 6V.

Figure 6W:
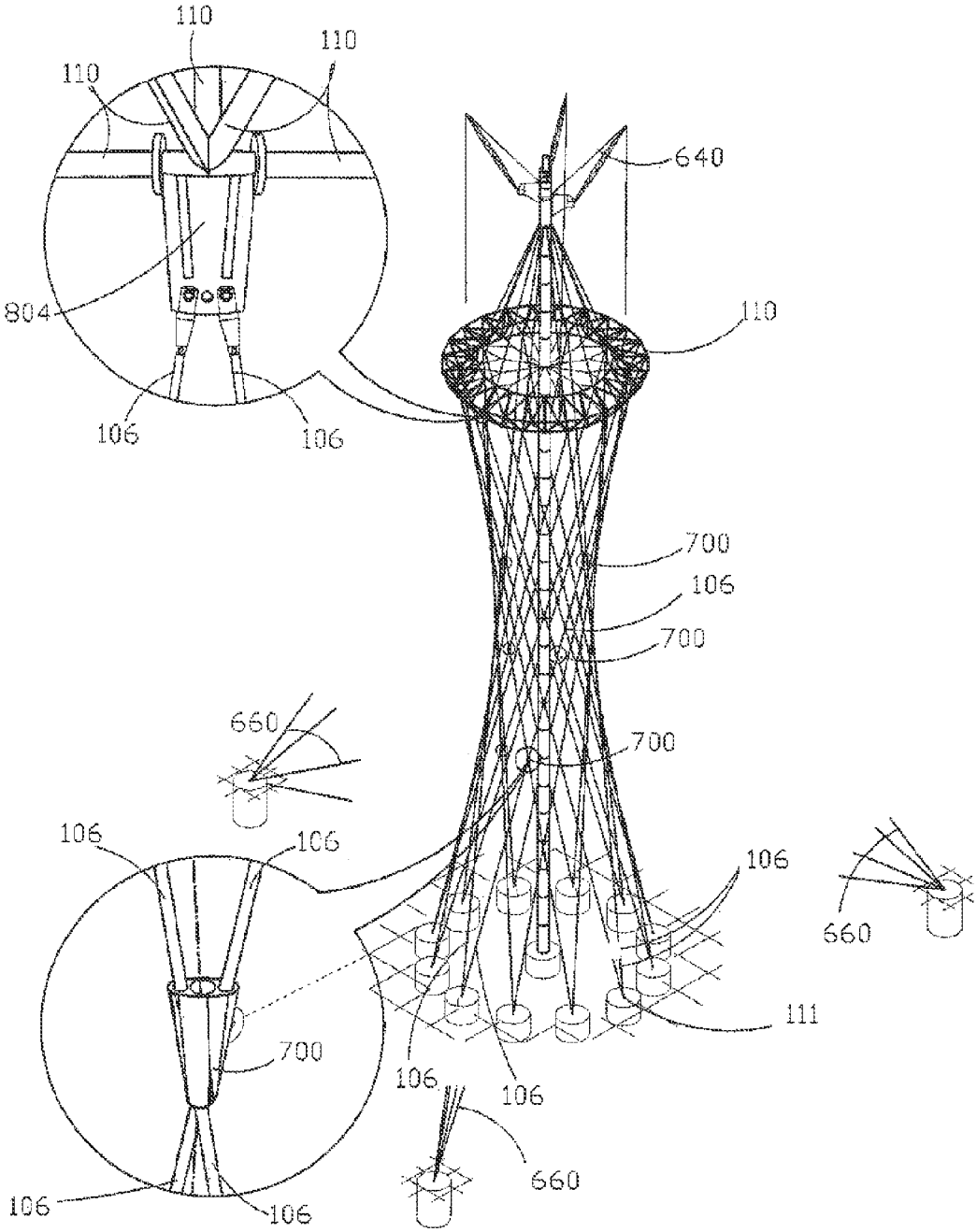

FIG. 6W shows positioning and attachment of all of the right and left tensioned elongate elements 106, typically 48 in number. For clarity, only 24 are shown. The connectors 700 are shown each threaded onto both a right tensioned elongate element 106 and a left tensioned elongate element 106.

Figure 6X:
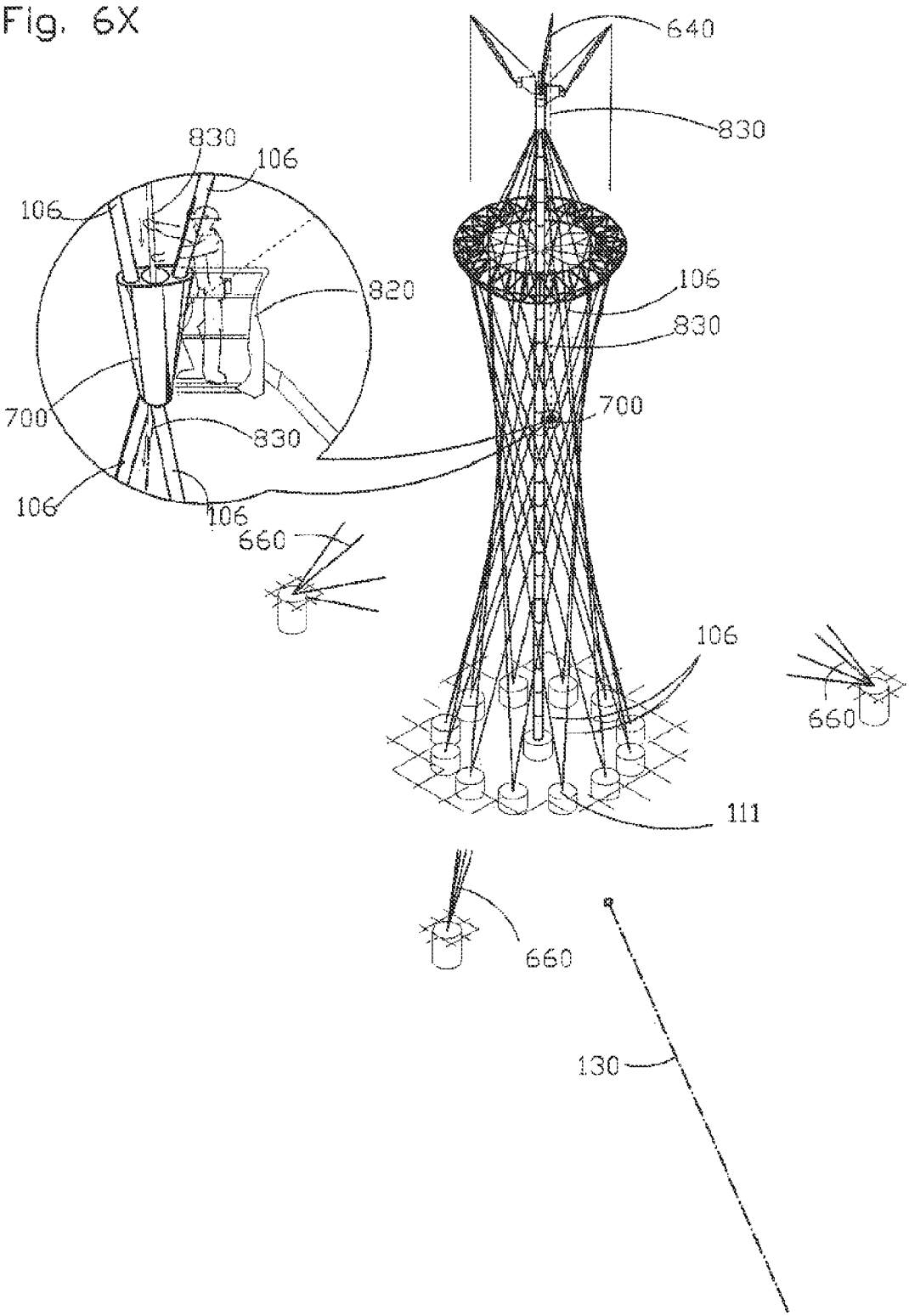
Figure 6Y:
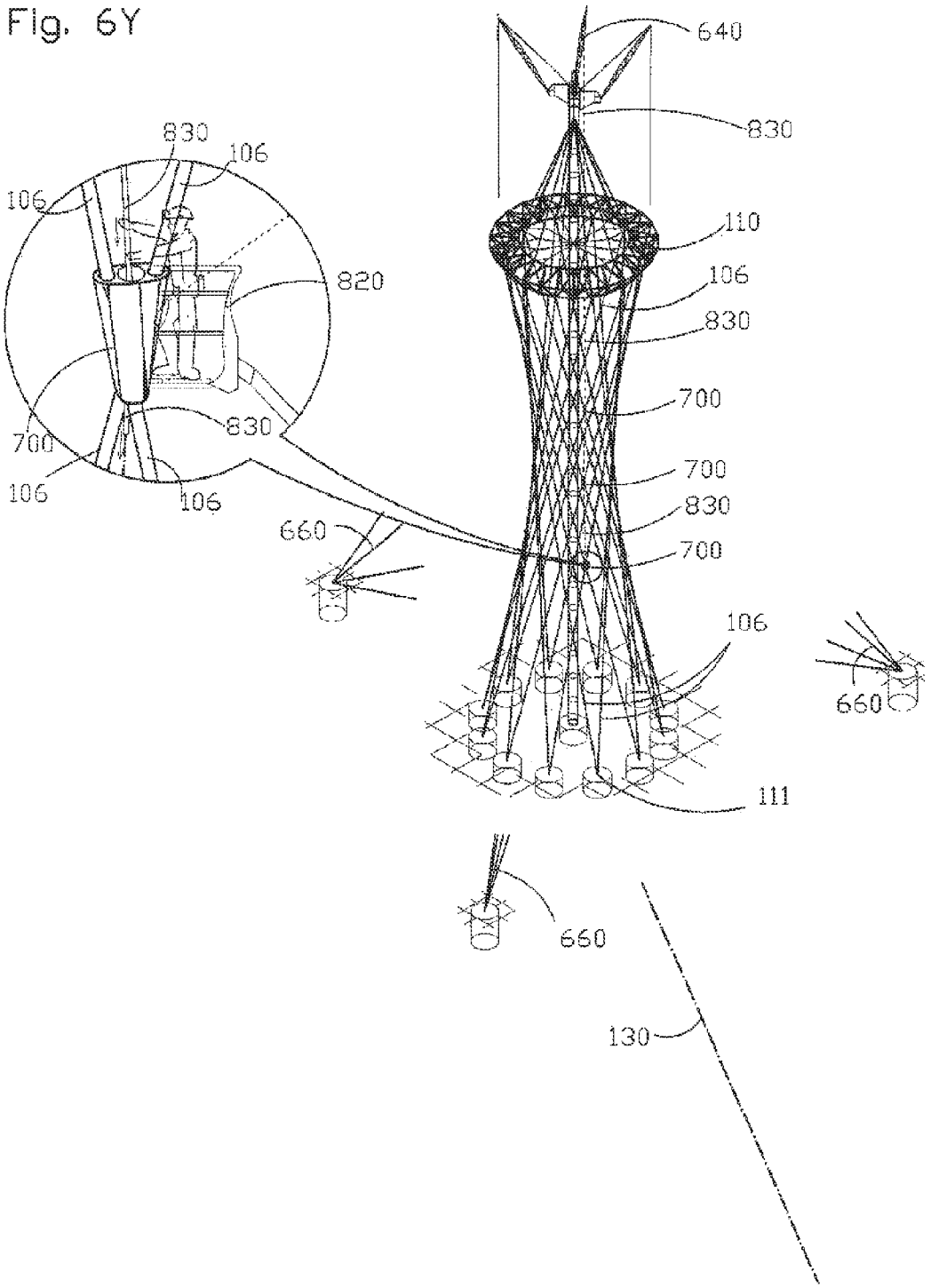

Turning now to FIG. 6X, there is seen a first step in positioning a first junction-to-junction joining tensioned elongate element 130 (FIGS. 1A & 1B). This is preferably done by lowering a first junction-to-junction joining tensioned elongate element lead wire 830 by means of crane 640 to a top most connector 700 which is already threaded by both left and right tensioned elongate elements 106, which are already positioned and connected but preferably not yet tensioned. A human operator is preferably lowered on a platform 820 by another crane in order to thread the first junction-to-junction joining tensioned elongate element lead wire 830 initially through a topmost connector 700 and thereafter through sequentially lower connectors 700, as shown in FIG. 6Y.

Figure 6Z:
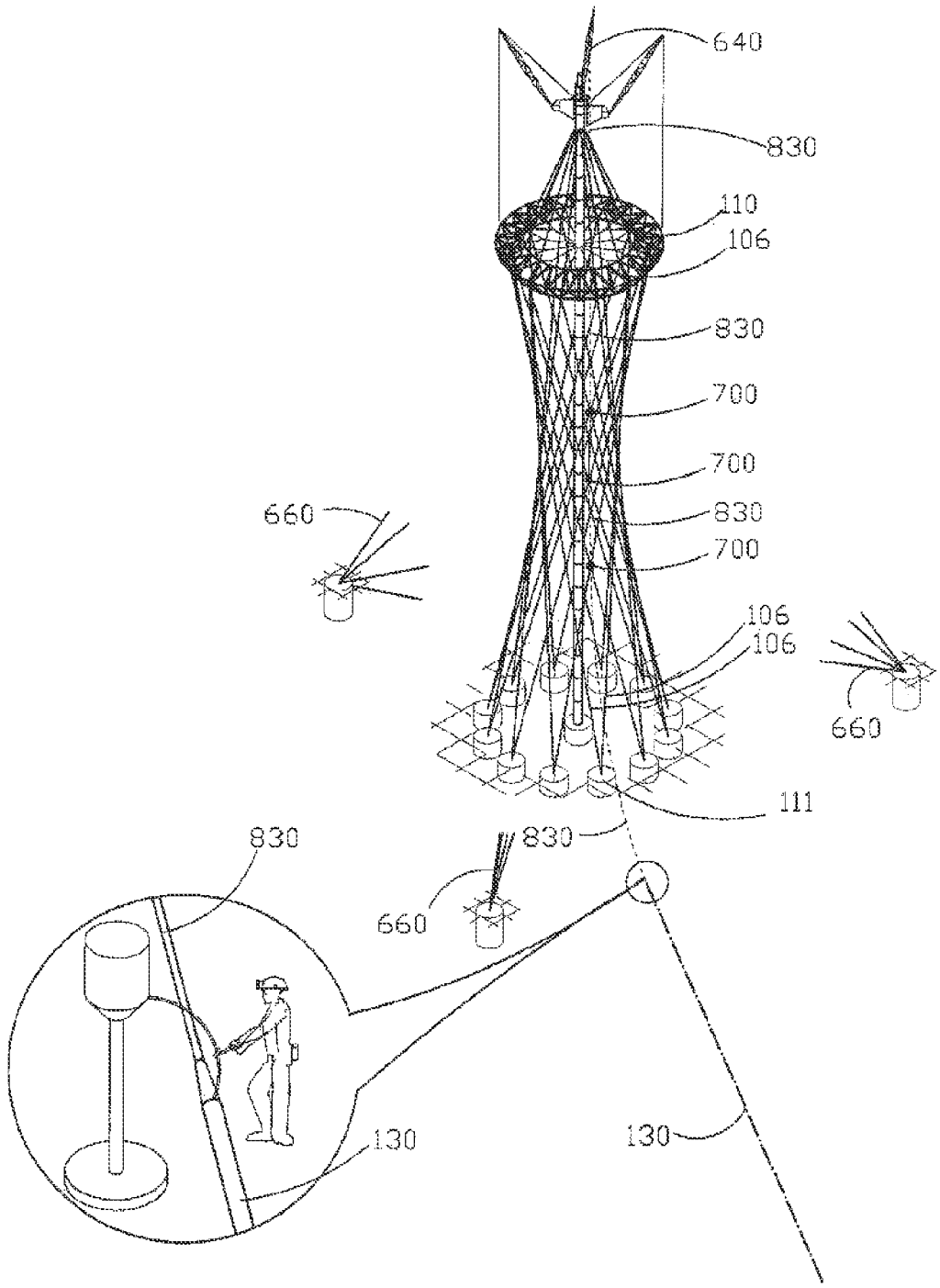
Figure 6A:
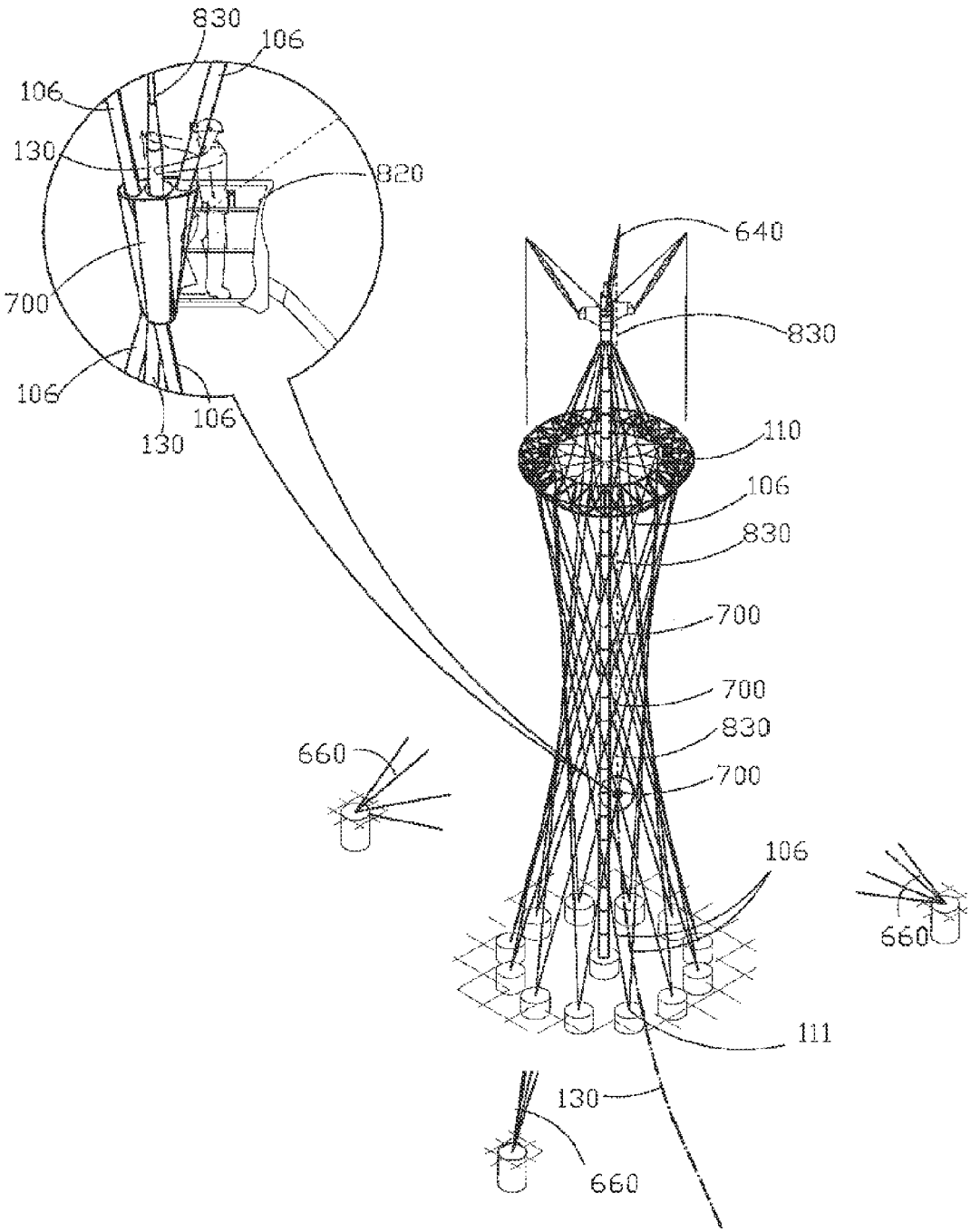
Figure 6B:
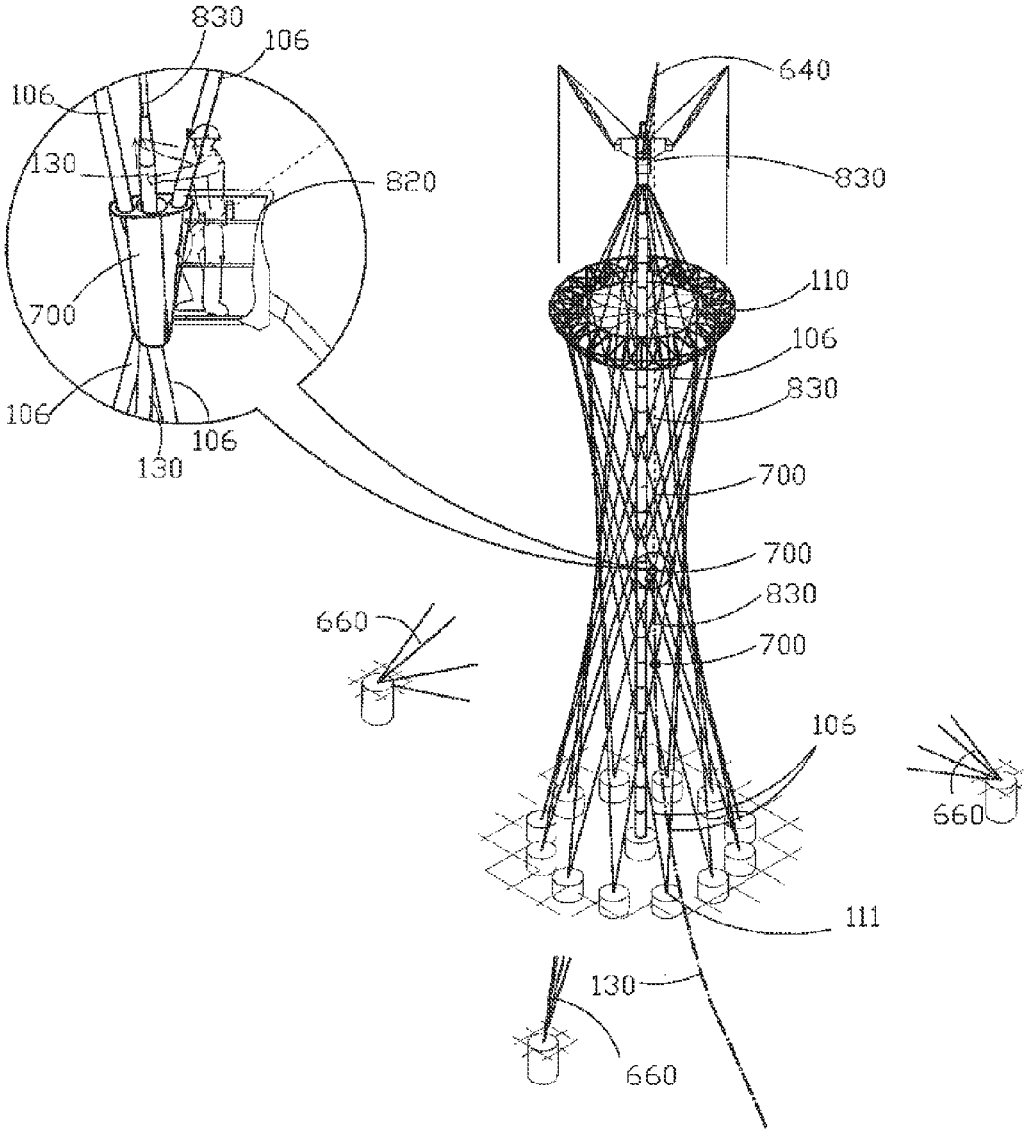
Figure 6C:
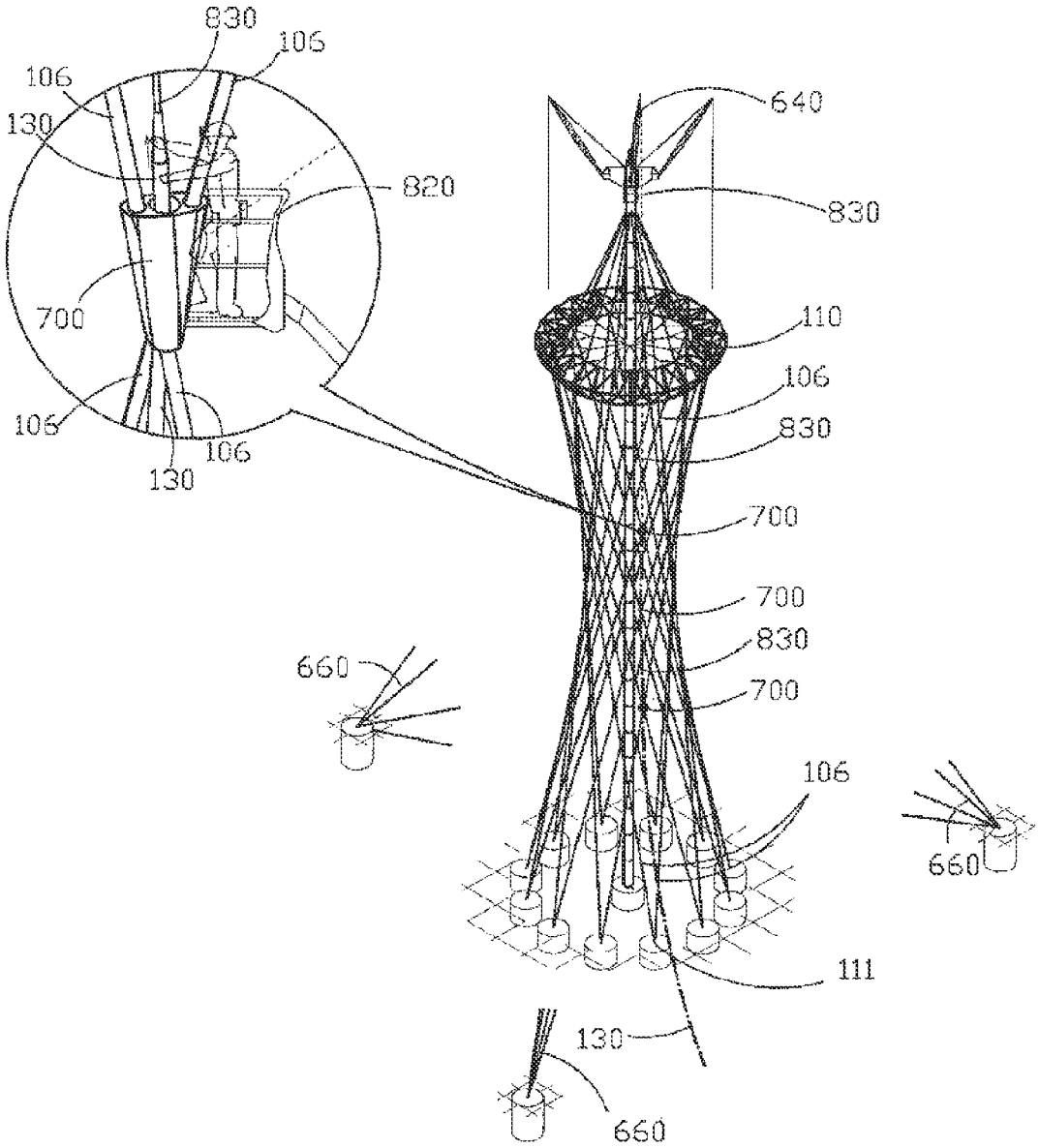
Figure 6D:
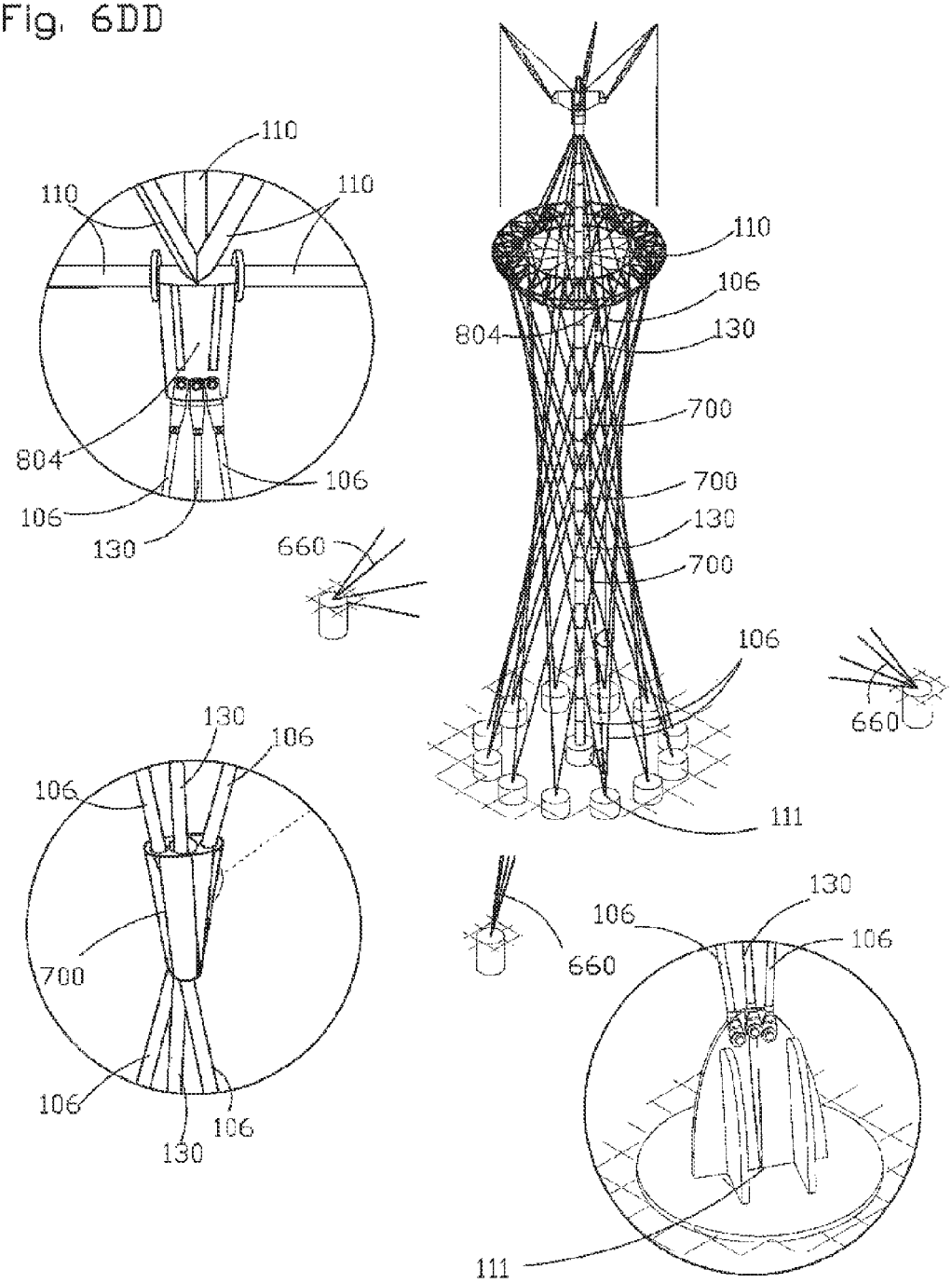
Figure 6E:
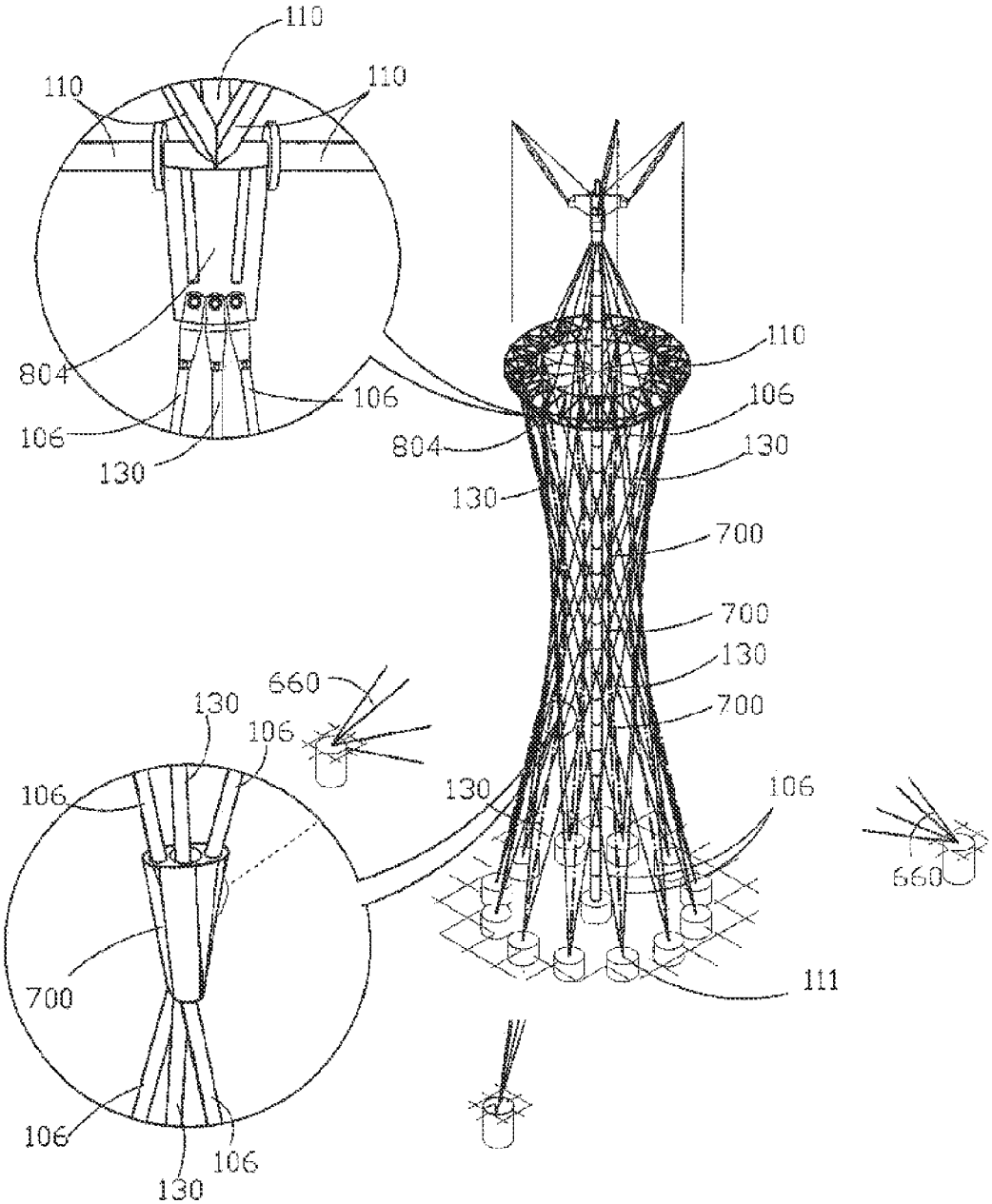
Figure 6F:
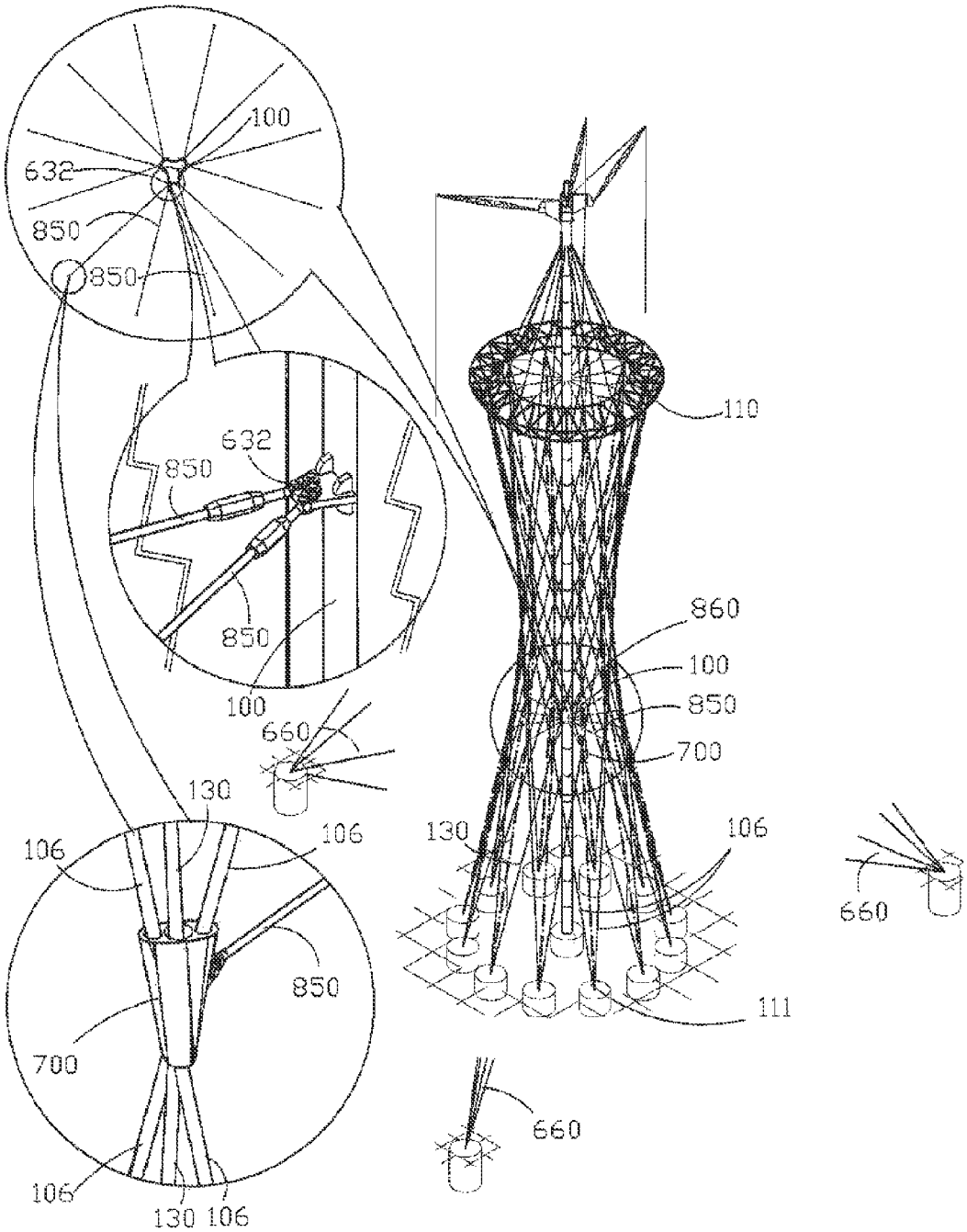
Figure 6G:
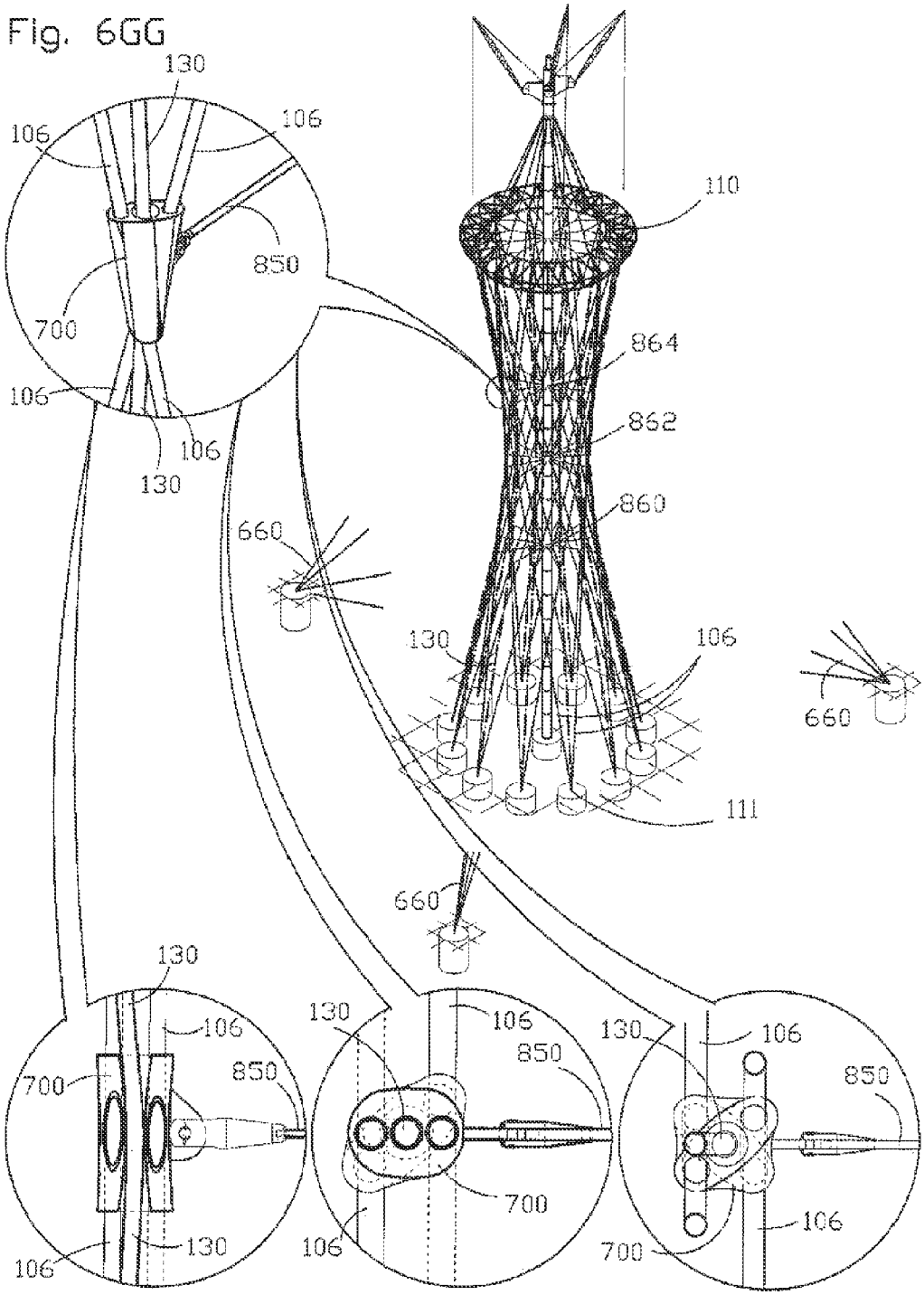
Figure 6H:
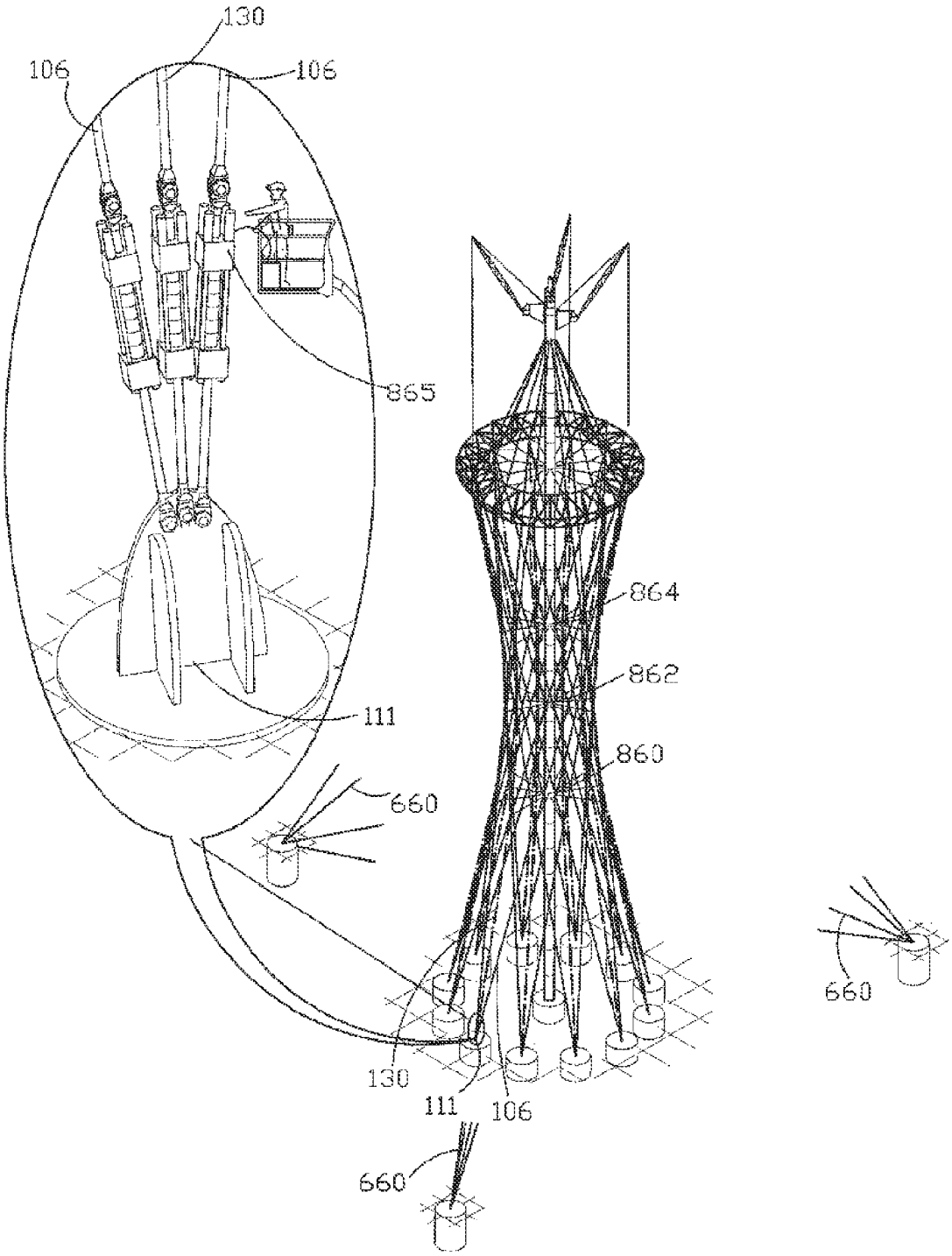
Figure 6J:
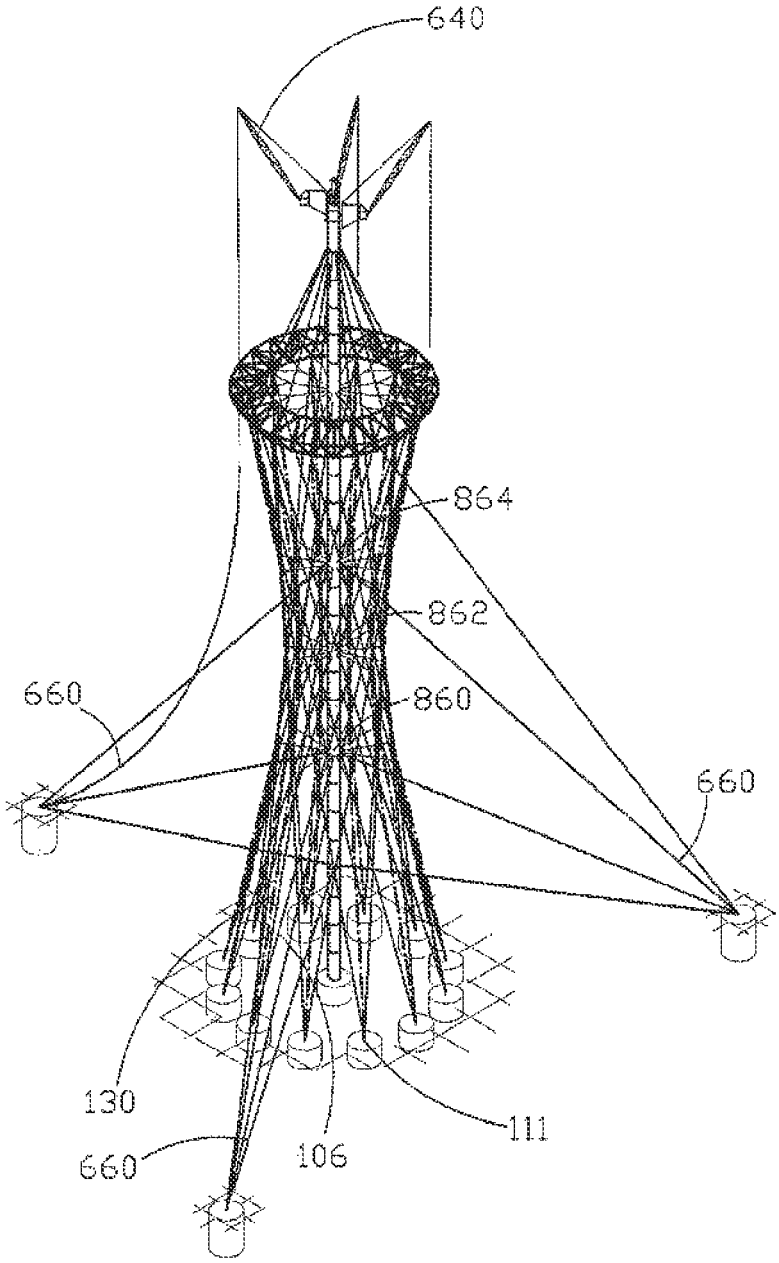
Figure 6K:
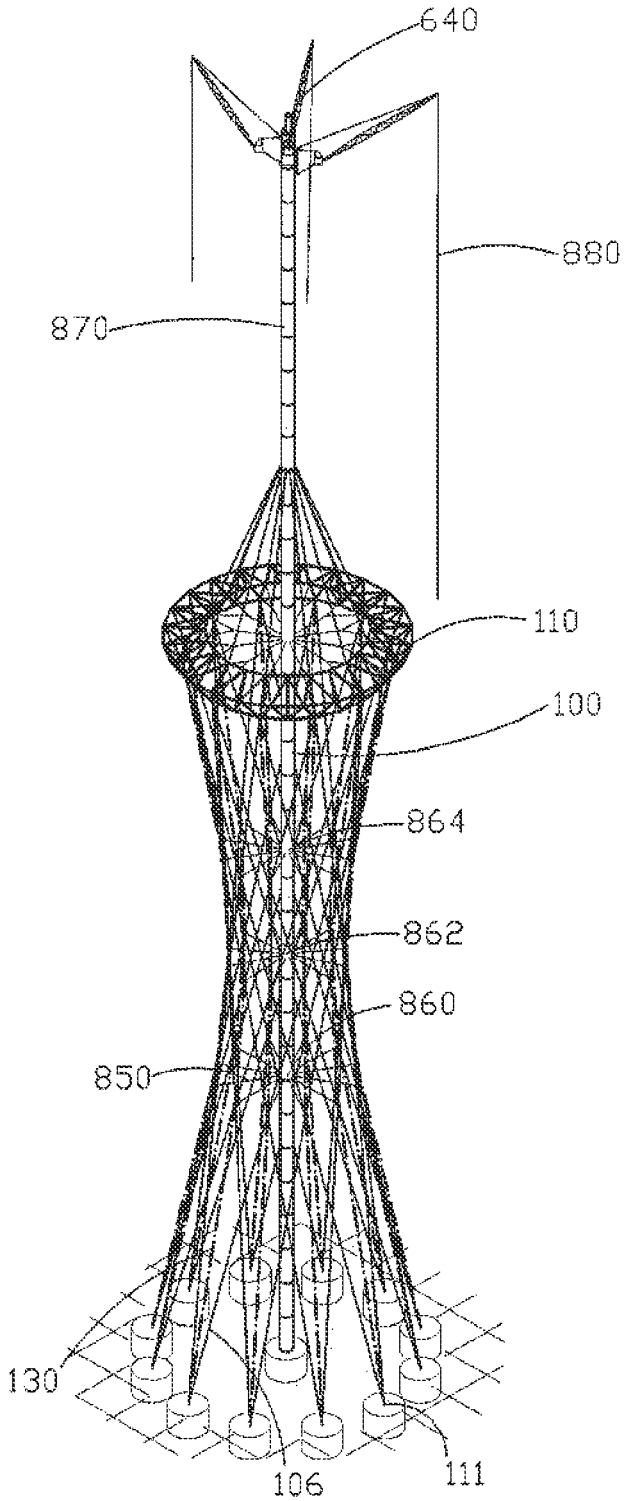
Figure 6L:
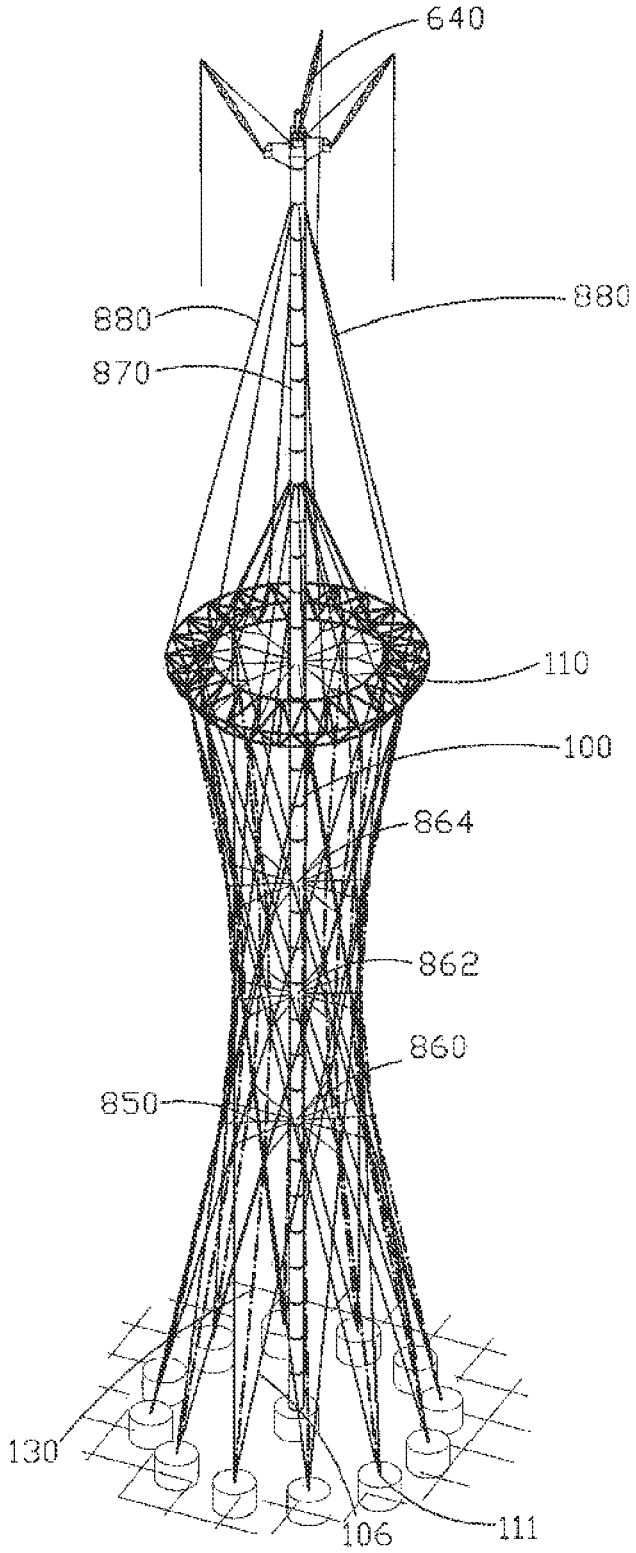
Figure 6M:
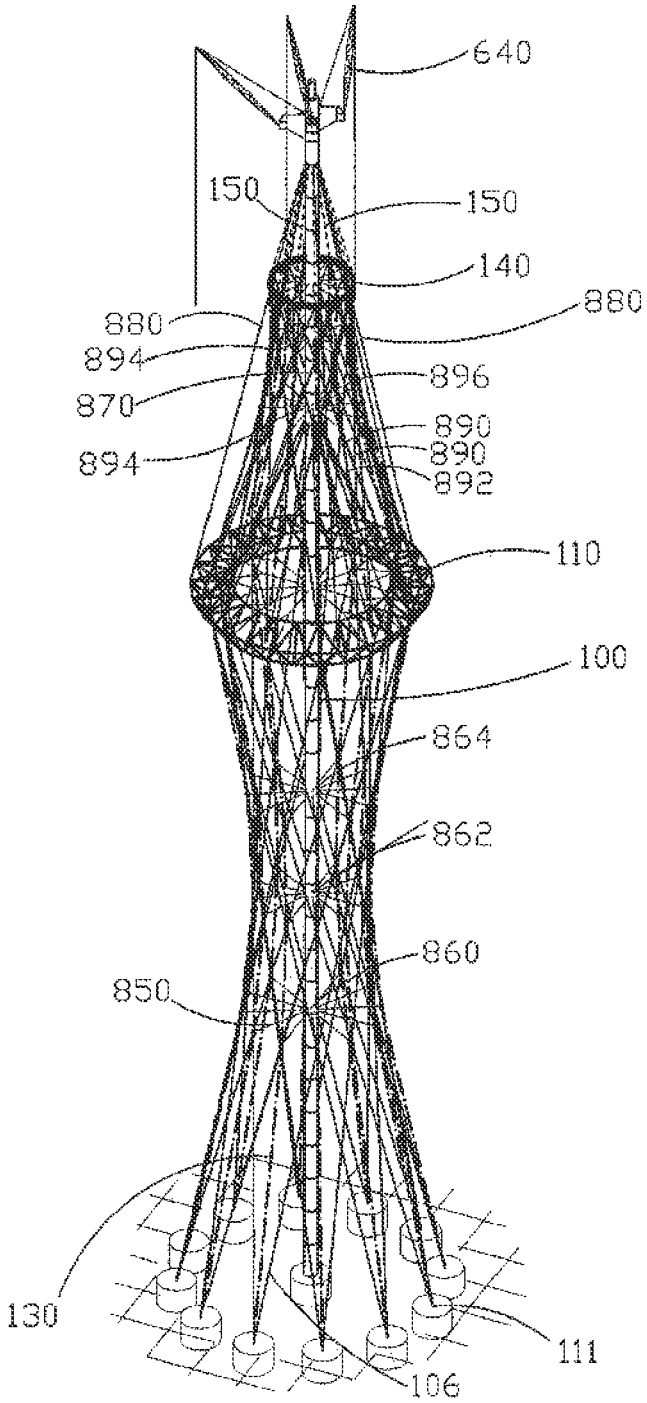
Figure 6N:
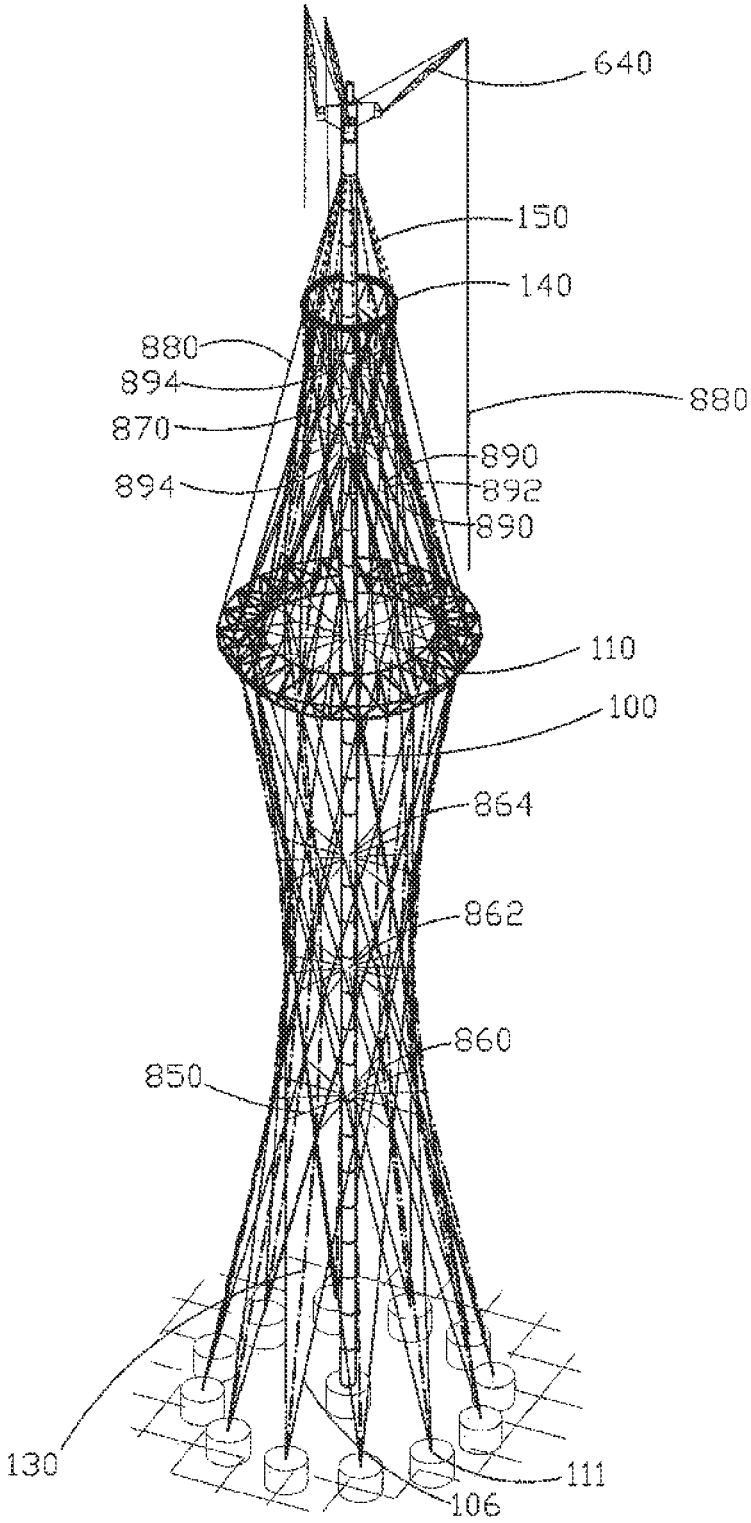
Figure 600:
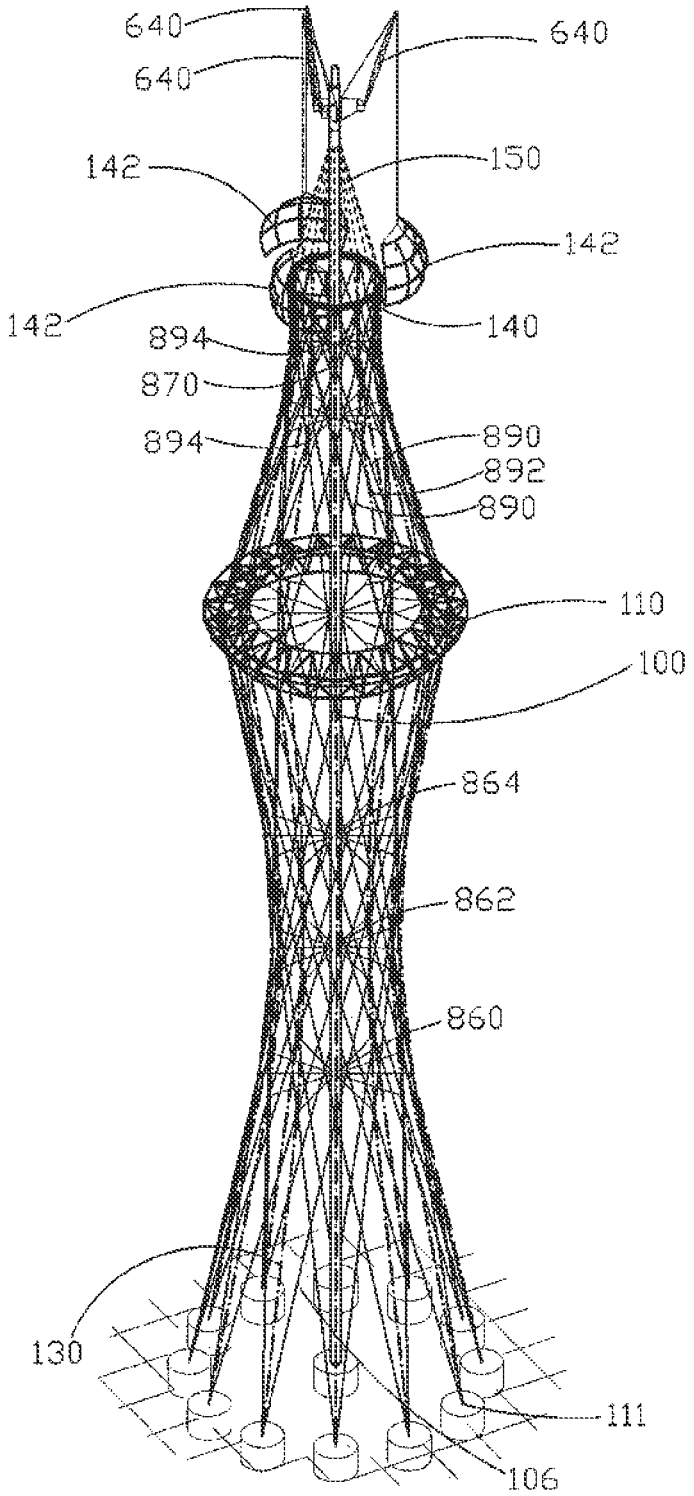
Figure 6P:
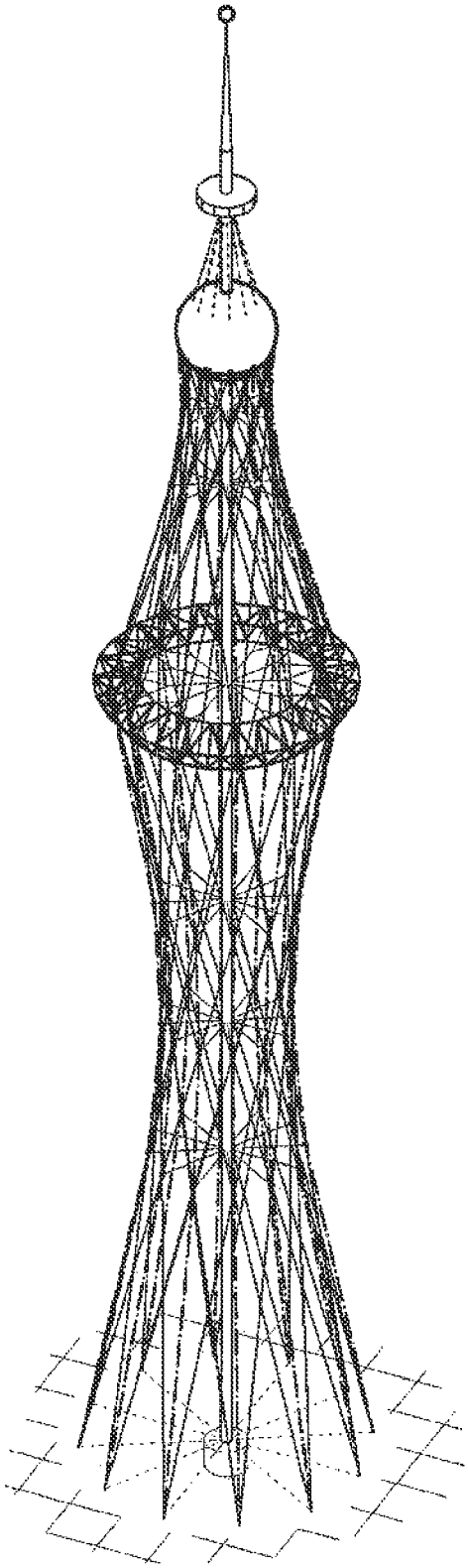

As shown in FIG. 6Z, once the lead wire 830 has been threaded through all of the connectors 700 through which the junction-to-junction joining tensioned elongate element 130 is intended to extend, the lower end of the lead wire 830 is attached to a first end of a first junction-to-junction joining tensioned elongate element 130, preferably, using a bonding agent, preferably an alloy of tin and lead. Hardening of the bonding agent bonds the tensioned element 106 to the lead wire 810. It is appreciated that the opposite end of the first junction-to-junction joining tensioned elongate element 130 may be mounted onto a foundation at an anchoring location 111.

The lead wire 830 is then pulled upwardly so as to thread the first junction-to-junction joining tensioned elongate element 130 through the various connectors 700 through which the lead wire 830 was earlier threaded, possibly with the assistance of a human operator, as seen in FIGS. 6AA, 6BB and 6CC. The upper end of the first junction-to-junction joining tensioned elongate element 130 is then attached to an apertured connector 804 formed on ring truss structure 110 (FIGS. 1A & 1B), as seen in FIG. 6DD.

FIG. 6EE shows positioning and attachment of junction-to-junction joining tensioned elongate elements 130, typically 24 in number. For clarity, only 12 are shown. The connectors 700 are shown each threaded onto a right tensioned elongate element 106 and a left tensioned elongate element 106 and to a junction-to-junction joining tensioned elongate element 130.

It is appreciated that connectors 700 are arranged in a plurality of horizontal planes, perpendicular to mast 100. Preferably all of the connectors 700 which lie in a given horizontal plane are each connected to mast 100 at a location in that plane by means of a tensioned element 120, here designated by reference numeral 850, such as a cable or rod which extends from each connector 700 to a corresponding apertured connector 632 on mast 100. Typically four tensioned elements 850 are attached to each apertured connector 632, although for simplicity only two are shown in the drawings. FIG. 6FF shows the tensioned elements 850 connected in one plane, here designated by reference numeral 860 and FIG. 6GG shows tensioned elements 850 connected in multiple planes, here designated by reference numerals 860, 862 and 864, it being appreciated that typically 6 or more planes may be provided.

The azimuth of the anchoring location of each junction-to-mast joining tensioned elongate element 850 on the mast 100 in a plane perpendicular to the mast 100 and centered thereon preferably differs from the azimuth of the attachment location of the same junction-to-mast joining tensioned elongate element 850 at a junction 108 by up to about 28 degrees.

Reference is now made to FIG. 6HH, which illustrates additional tensioning of tensioned elements 106 and 130, which is effected utilizing tensioners 865 mounted onto tensioned elements 106 and 130. This tensioning can be realized, for example, by employing equipment or services provided by Daversteels of South Yorkshire, UK or by Macalloy Ltd. of Sheffield, UK. It is appreciated that elements 106, 120 and 130 are always maintained under tension, even in the absence of side forces resulting from wind and earthquakes. Preferably elements 106 and 130 are each maintained under tension of approximately 600 tons. Elements 120 are each preferably maintained under tension of approximately 100 tons. As a result, elements 146 are each maintained under tension of approximately 1800 tons.

Thereafter, as seen in FIG. 6II, the connectors 700 are permanently fixed to the right tensioned elements 106 and tensioned elements 130. The permanent fixing is preferably carried out by pouring a bonding agent, preferably an alloy of tin and lead, into the interior spaces of connectors 700 which surround the right tensioned elements 106 and tensioned elements 130. Hardening of the bonding agent bonds the right tensioned elements 106 and tensioned elements 130 to the connectors and prevents relative motion therebetween.

At this stage the arrangement of tensioned elements 106 and 130 and connectors 700 with respect to the mast 100 is preferably such that side forces on the tower structure are transferred via tensioned elements 106, 130 and 120 to anchoring foundations at locations 111 and accordingly, the temporary stabilizing cables 660 may be removed, as shown in FIG. 6JJ.

Typically following removal of the temporary stabilizing cables 660, further sections 870 are added to the mast 100, using cranes 640, as shown in FIG. 6KK, generally in the same manner as described hereinabove with reference to FIGS. 6B-6E. FIG. 6KK also shows raising a temporary support element 880.

FIG. 6LL shows plural temporary support elements 880 in place for providing support to the additional sections 870 against side forces. In this case, the ring structure 110 provides anchoring foundations for the temporary support elements 880.

FIG. 6MM shows provision of right and left tensioned elements 890, junction-to-junction joining tensioned elongate elements 892, connected thereto by connectors 894, and radially extending tensioned elements 896 joining ring structure 140 and ring truss structure 110. These elements are then suitably tensioned. Realization of the additional structure of FIG. 6MM is generally in accordance with that described hereinabove with reference to FIGS. 6H-6II. At this stage the arrangement of tensioned elements 890 and 892 and connectors 894 with respect to the additional sections 870 of the mast 100 is preferably such that side forces on the additional structures 870 and ring structure 140 are transferred via tensioned elements 890 and 892 to anchoring foundations defined by ring truss structure 110 and accordingly, the temporary stabilizing cables 880 may be removed, as shown in FIG. 6NN.

Thereafter, as seen in FIG. 6OO, spherical structure 142 is mounted onto upper ring structure 140 as by cranes 640. A final structure is shown in FIG. 6PP.

It will be appreciated by persons skilled in the art that the present invention is not limited by what has been particularly shown and described hereinabove. Rather the scope of the present invention includes both combinations and subcombinations of features recited in the claims as well as modifications thereof which would occur to a person of ordinary skill in the art upon reading the foregoing and which are not in the prior art.

The invention claimed is:

1. A tower structure comprising:

a central, vertical mast; and a plurality of tensioned elongate elements arranged to support said mast against buckling, said plurality of tensioned elements together defining a generally hyperboloid structure and including:

a first plurality of elongate elements which define a multiplicity of junctions therebetween;

a second plurality of junction-to-mast joining elongate elements which join at least some of said multiplicity of junctions to said central, vertical mast; and a third plurality of junction-to-junction joining elongate elements which are connected at a plurality of mutually spaced fixed locations therealong to said at least some of said multiplicity of junctions; and further comprising a ring truss structure; wherein said ring truss structure houses a restaurant facility, said restaurant facility having a ring configuration and extending generally in a circle through 360 degrees in a plane perpendicular to said mast, said ring configuration providing both interior facing and exterior facing views.

2. A tower structure according to claim 1 wherein said first plurality of tensioned elongate elements are at least generally straight.

3. A tower structure according to claim 2 wherein said third plurality of tensioned elongate elements are generally parabolic.

4. A tower structure according to claim 3 further comprising a multiplicity of connectors operative to interconnect said first plurality of tensioned elongate elements with said second plurality of elongate elements and said third plurality of tensioned elongate elements at said multiplicity plurality of junctions.

5. A tower structure according to claim 2 further comprising a multiplicity of connectors operative to interconnect said first plurality of tensioned elongate elements with said second plurality of elongate elements and said third plurality of tensioned elongate elements at said multiplicity plurality of junctions.

6. A tower structure according to claim 1 wherein said third plurality of tensioned elongate elements are generally parabolic.

7. A tower structure according to claim 1 further comprising a multiplicity of connectors operative to interconnect said first plurality of tensioned elongate elements with said second plurality of elongate elements and said third plurality of tensioned elongate elements at said multiplicity plurality of junctions.

8. A tower structure according to claim 1 wherein said restaurant facility includes multiple seating levels.

9. A tower structure according to claim 1 wherein said interior facing views include views of substantially the entire restaurant facility and the ring truss structure as well as of tensioned elements of said tower structure.

10. A tower structure according to claim 1 further comprising multiple 360 degree ring platforms, at least a first one of said multiple 360 degree ring platforms being stationary; and at least a second one of said multiple 360 degree ring platforms including at least a portion which is driven in 360 degree motion in a horizontal plane about said mast.

* * * * *